US009727001B2

(12) United States Patent
Kaneko et al.

(10) Patent No.: US 9,727,001 B2
(45) Date of Patent: Aug. 8, 2017

(54) TECHNIQUE FOR REDUCING UNEVEN IMAGE DENSITY IN AN IMAGE FORMING APPARATUS

(71) Applicants: Satoshi Kaneko, Kanagawa (JP); Shuji Hirai, Tokyo (JP); Terumichi Ochi, Kanagawa (JP)

(72) Inventors: Satoshi Kaneko, Kanagawa (JP); Shuji Hirai, Tokyo (JP); Terumichi Ochi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/090,252

(22) Filed: Apr. 4, 2016

(65) Prior Publication Data

US 2016/0299452 A1 Oct. 13, 2016

(30) Foreign Application Priority Data

Apr. 9, 2015 (JP) ..... 2015-080240

(51) Int. Cl.
*G03G 15/02* (2006.01)
*G03G 15/00* (2006.01)

(52) U.S. Cl.
CPC ..... *G03G 15/0266* (2013.01); *G03G 15/5037* (2013.01)

(58) Field of Classification Search
CPC ..... G03G 15/0266
See application file for complete search history.

(56) References Cited

U.S. PATENT DOCUMENTS

2010/0239285 A1* 9/2010 Shibuya ..... G03G 15/0266 399/50
2013/0108288 A1 5/2013 Kaneko et al.
2013/0108292 A1 5/2013 Suzuki et al.
2013/0243456 A1* 9/2013 Kaneko ..... G03G 13/22 399/48
2013/0243457 A1 9/2013 Kaneko et al.
(Continued)

FOREIGN PATENT DOCUMENTS

JP 2000-098675 4/2000
JP 2002-207350 7/2002
(Continued)

*Primary Examiner* — Quana M Grainger
(74) *Attorney, Agent, or Firm* — Duft Bornsen & Fettig LLP

(57) ABSTRACT

An image forming apparatus includes an image forming device, an electric current detector, and a controller. The image forming device includes a latent image bearer, a charging rotator, a charging power supply, a latent image writing unit, and a developing unit. The controller (i) determines an uneven electric resistance of the charging rotator in a direction of rotation of the charging rotator, based on a detection result by the electric current detector, (ii) perform, at a predetermined timing, data construction processing to construct change pattern data to change an output value of a voltage from the charging power supply according to a predetermined pattern, based on the uneven electric resistance, and (iii) perform, in a print job to form a toner image in response to an instruction, voltage changing processing to charge the latent image bearer while changing the output value of the voltage, based on the change pattern data.

9 Claims, 12 Drawing Sheets

(56) References Cited

U.S. PATENT DOCUMENTS

| | | | | |
|---|---|---|---|---|
| 2014/0169814 | A1 | 6/2014 | Uematsu et al. | |
| 2014/0268242 | A1 | 9/2014 | Kaneko et al. | |
| 2014/0270827 | A1 | 9/2014 | Muto et al. | |
| 2014/0270828 | A1 | 9/2014 | Suzuki et al. | |
| 2014/0301748 | A1 | 10/2014 | Suzuki et al. | |
| 2015/0116718 | A1 | 4/2015 | Ochi et al. | |
| 2015/0261162 | A1* | 9/2015 | Kaneko | G03G 15/5041 399/72 |
| 2015/0362879 | A1 | 12/2015 | Kaneko et al. | |
| 2016/0062260 | A1 | 3/2016 | Kaneko et al. | |

FOREIGN PATENT DOCUMENTS

| | | | |
|---|---|---|---|
| JP | 2013-024940 | | 2/2013 |
| JP | 2013024940 | A * | 2/2013 |

* cited by examiner

TECHNIQUE FOR REDUCING UNEVEN IMAGE DENSITY IN AN IMAGE FORMING APPARATUS

CROSS-REFERENCE TO RELATED APPLICATION

This patent application is based on and claims priority pursuant to 35 U.S.C. §119(a) to Japanese Patent Application No. 2015-080240, filed on Apr. 9, 2015, in the Japan Patent Office, the entire disclosure of which is hereby incorporated by reference herein.

BACKGROUND

Technical Field

Aspects of the present disclosure relate to a liquid discharge head, a liquid discharge device, and a liquid discharge apparatus, and an image forming apparatus.

Related Art

An image forming apparatus includes, for example, a charging member to charge a surface of a latent image bearer while rotating, a charging power supply to output the voltage to be applied to the charging member, and a latent-image writer to write a latent image on the surface of the latent image bearer charged by the charging member.

For example, an image forming apparatus includes a charging roller as the charging member to charge a photoconductor as the latent image bearer in contact with the photoconductor. When no image forming operation is performed, the image forming apparatus detaches the charging roller from the photoconductor and brings the charging roller into contact with a conductive roller. Then, while rotating the charging roller and the conductive roller, the image forming apparatus detects electric current flowing between the charging roller and the conductive roller and uneven electric resistance in a direction of rotation of the charging roller based on the results of detection. When the magnitude of the uneven electric resistance is greater than a predetermined value, the image forming apparatus creates change pattern data to change the voltage to be applied to the charging member, according to a predetermined pattern. While rotating the charging roller, the image forming apparatus changes the output value from the power supply according to the change pattern data. Changing the output value is performed in order to reduce the uneven electric resistance of the charging roller and prevent uneven image density due to the uneven electric resistance.

SUMMARY

In an aspect of this disclosure, there is provided an image forming apparatus that includes an image forming device, an electric current detector, and a controller. The image forming device includes a latent image bearer, a charging rotator, a charging power supply, a latent image writing unit, and a developing unit. The charging rotator charges a surface of the latent image bearer while rotating. The charging power supply outputs a voltage to be applied to the charging rotator. The latent image writing unit writes a latent image on the surface of the charged latent image bearer. The developing unit develops the latent image to obtain a toner image. The electric current detector detects a current flowing between the charging rotator to which the voltage output from the charging power supply is applied and the latent image bearer. The controller (i) determines an uneven electric resistance of the charging rotator in a direction of rotation of the charging rotator, based on a detection result by the electric current detector, (ii) perform, at a predetermined timing, data construction processing to construct change pattern data to change an output value of the voltage from the charging power supply according to a predetermined pattern, based on the uneven electric resistance, and (iii) perform, in a print job to form a toner image in response to an instruction, voltage changing processing to charge the latent image bearer while changing the output value of the voltage from the charging power supply, based on the change pattern data.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
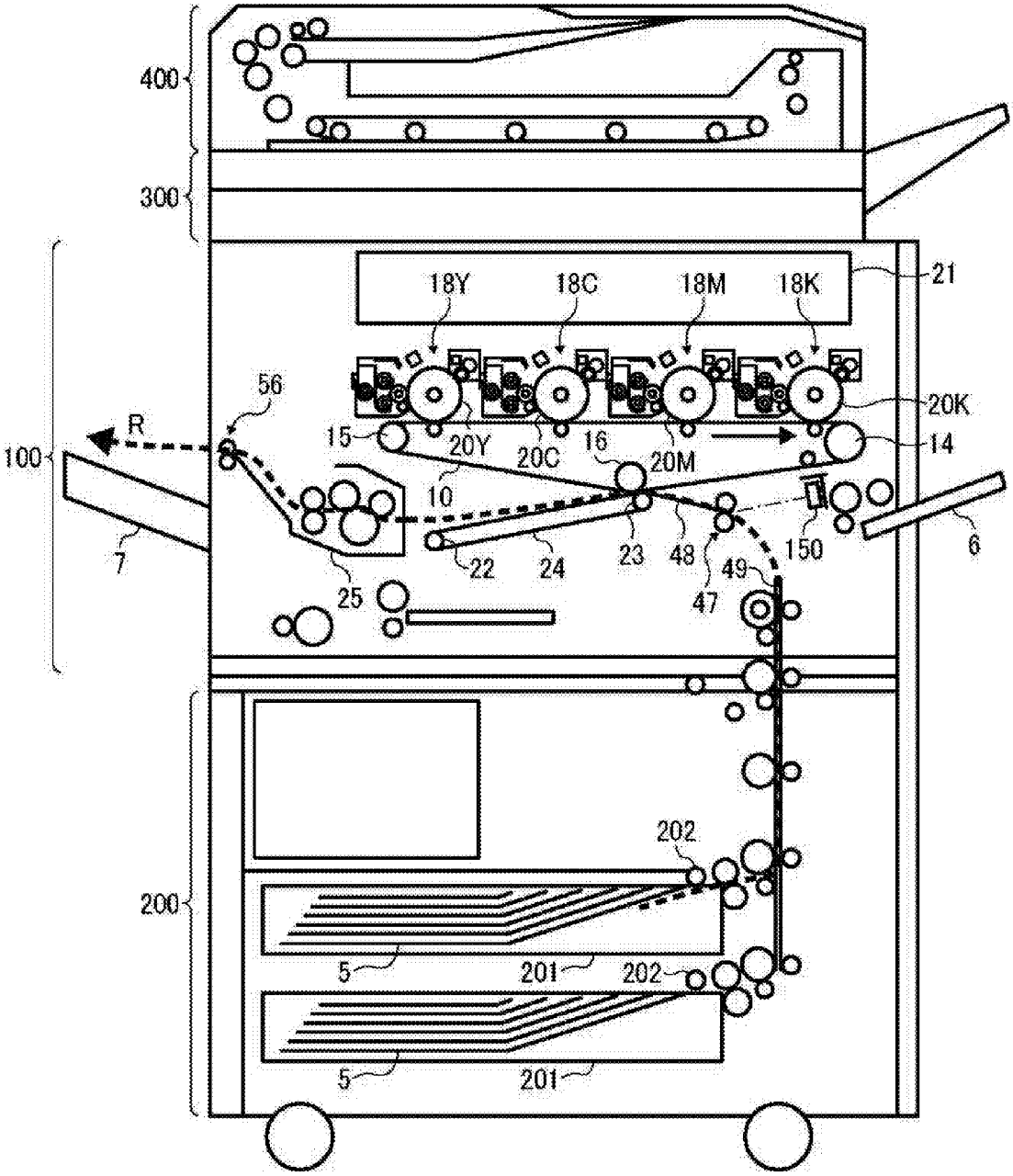
FIG. 1 is a schematic view of a configuration of a copier illustrated as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Below, a description is given of an electrophotographic full-color copier (hereinafter, simply a copier) as an image forming apparatus according to an embodiment of the present disclosure. A basic structure of the copier will be first described.

FIG. 1 schematically illustrates the copier according to an embodiment of the present invention. As illustrated in FIG. 1, the copier includes an image forming section 100 to form an image on a recording sheet, a sheet feed device 200 to supply a recording sheet 5 to the image forming section 100, and a scanner 300 to read the image in an original. In addition, an automatic document feeder (ADF) 400 is disposed on an upper part of the scanner 300. The image forming section 100 includes a bypass tray 6 to set the recording sheet 5 manually, and a stack tray 7 to stack the recording sheet 5 on which the image has been formed.

Figure 2:
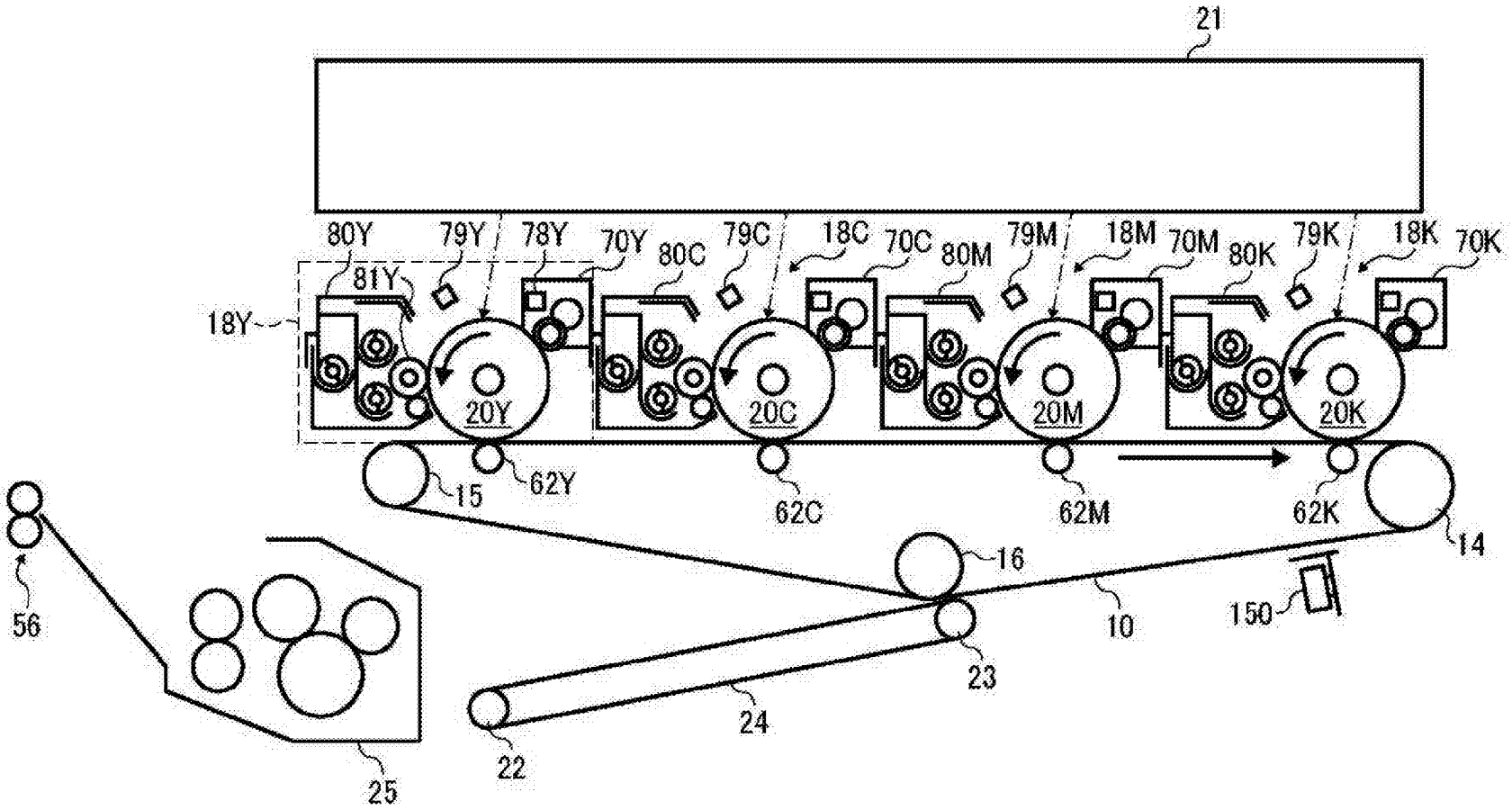
FIG. 2 is an enlarged view of an image forming section of the copier of FIG. 1.

FIG. 2 is an enlarged view of a configuration of the image forming section 100 of FIG. 1. An intermediate transfer belt 10 as a transfer body of an endless shape is disposed in the image forming section 100. The intermediate transfer belt 10 moves endlessly in a clockwise direction while being stretched around three support rollers 14, 15, and 16, one roller of which rotatably drives the intermediate transfer belt 10. In addition, four image forming units corresponding to the colors of yellow (Y), cyan (C), magenta (M), and black (K) are disposed opposite a surface of the intermediate transfer belt 10 moving between a first support roller 14 and a second support roller 15 among the support rollers 14, 15, and 16. An optical sensor unit 150 to detect an image density (that is, toner adhesion amount per unit area) of a toner image formed on the intermediate transfer belt 10 is disposed opposite the surface of the intermediate transfer belt 10 moving between the first support roller 14 and a third support roller 16.

As illustrated in FIG. 1, a laser writer 21 as an optical writing unit is disposed above image forming units 18Y, 18C, 18M, and 18K. The laser writer 21 drives a semiconductor laser through a laser controller, based on image information read by the scanner 300, to emit writing light. With the writing light, the laser writer 21 exposes and scans a surface of drum-shaped photoconductors 20Y, 20C, 20M, and 20K, each being a latent image bearer disposed in each of the image forming units 18Y, 18C, 18M, and 18K, thereby forming an electrostatic latent image on the photoconductors. The present light source employs a laser diode, but alternatively may employ a light-emitting diode (LED), for example.

Figure 3:
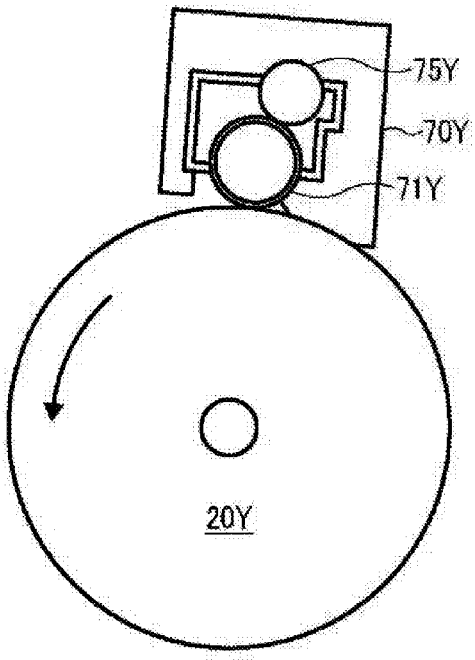
FIG. 3 is an enlarged view illustrating a photoconductor and a charger for Y-color in the image forming section of FIG. 2.

FIG. 3 is an enlarged view of the photoconductor 20Y and a charger 70Y each for yellow color. Parts and components for the Y-color will be described as a representative example. The charger 70Y includes a charging roller 71Y that contacts the photoconductor 20Y and rotates following a rotation of the photoconductor 20Y, a charge cleaning roller 75Y that contacts the charging roller 71Y and rotates following a rotation of the charging roller 71Y, and a rotational position sensor 76Y.

Figure 4:
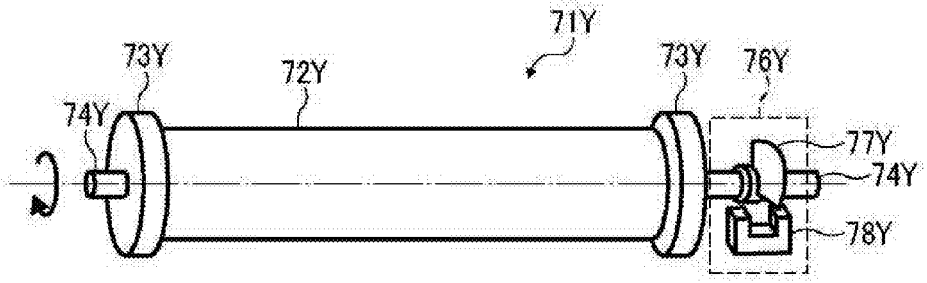
FIG. 4 is an enlarged view of a charging roller of the charger of FIG. 3.

FIG. 4 is an enlarged view of the charging roller 71Y for yellow color. The charging roller 71Y includes a columnar body 72Y, large-diameter portions 73Y disposed at both ends of the body 72Y in a rotary axis direction, and a rotary shaft 74Y rotatably supported by shaft bearings. The body 72Y includes a columnar cored bar, a conductive layer with which the surface of the columnar cored bar is coated, and a surface layer with which the surface of the conductive layer is coated. A large-diameter portion 73 molded in a disc shape having a larger diameter than the body 72Y is made of insulating material. The rotary shaft 74Y is made of metal and is conducted to the cored bar of the body 72Y. The charging roller 71Y configured as described above is biased against a photoconductor 20Y by a biasing unit (not shown) so that the two large-diameter portions 73Y each disposed on each of the both ends in the rotary axis direction are brought in contact with the photoconductor. This contact makes the charging roller 71Y be dragged to rotate with the photoconductor. The body 72Y having a smaller diameter than the large-diameter portion 73Y creates a fine gap between itself and the photoconductor. An electric discharge is generated in the fine gap, so that the surface of the photoconductor is charged uniformly. In order to generate such an electric discharge, a charging bias is applied to the rotary shaft 74Y conducted to the cored bar of the body 72Y, where the charging bias is constituted by a superimposed voltage in which a direct current voltage and an alternating current voltage are superimposed. Note that, instead of the charging roller 71Y shown in the drawing, a contact-type charging roller may be used which has no large-diameter portions and the body of which is in contact with the photoconductor.

One end of the rotary shaft 74Y that projects from each end surface of the two large-diameter portions 73Y passes through the rotational position sensor 76Y, and a portion projecting from the rotational position sensor 76Y is received by the shaft bearing. The rotational position sensor 76Y includes, e.g., a light shield 77Y that is secured to the rotary shaft 74Y and rotates with the rotary shaft 74Y, and a transmission-type photosensor 78Y. The light shield 77Y has a shape protruding in a normal line direction at a predetermined peripheral portion of the rotary shaft 74Y. When the charging roller 71Y takes a predetermined rotational position, the light shield 77Y interposes between a light emitting element and a light receiving element of the transmission-type photosensor 78Y. With this structure, when the light receiving element does not receive light, output voltage from the transmission-type photosensor 78Y greatly decreases. Specifically, the transmission-type photosensor 78Y detects that the charging roller 71Y takes a predetermined rotary position, and greatly decreases the output voltage.

Figure 5:
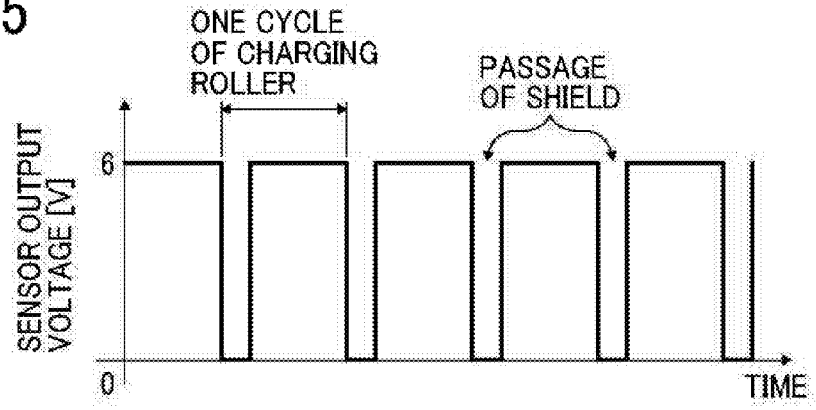
FIG. 5 is a graph of a change over time in output voltage from a rotational position sensor for Y-color in the charger of FIG. 3.

FIG. 5 is a graph showing a change over time in the output voltage from the rotational position sensor 76Y for Y-color. More specifically, note that the output voltage from the rotational position sensor 76Y is an output voltage from the transmission-type photosensor 78Y. As illustrated in FIG. 5, when the charging roller 71Y rotates, voltage of 6 volts is output from the rotational position sensor 76Y. However, each time the charging roller 71Y rotates once, the output voltage from the rotational position sensor 76Y drastically declines to near 0 volts instantaneously. This is because each time the charging roller 71Y rotates once, the light receiving element does not receive light due to the light shield 77Y existing between the light emitting element and the light receiving element of the transmission-type photosensor 78Y. Specifically, the output voltage greatly decreases at a timing when the charging roller 71Y takes a predetermined rotational position.

In FIG. 3, the charge cleaning roller 75Y of the charger 70Y includes a conductive cored bar and an elastic layer coated on the peripheral surface of the cored bar. The elastic layer is formed of a sponge material formed by minutely foaming melamine resins. By rotating while contacting the body 72Y of the charging roller 71Y, the elastic layer removes residual toner or dust from the body 72Y, thus preventing occurrence of abnormal images. The elastic layer also contains a material different from ionic conductive agent, such as carbon, as a resistance adjusting agent for adjusting electric resistance.

In FIG. 2, the four image forming units 18Y, 18C, 18M, and 18K are configured to be substantially similar to each other, except that each of the image forming units 18Y, 18C, 18M, and 18K handles a different color of toner. The image forming unit 18Y to form a Y-color toner image as an example includes the photoconductor 20Y, the charger 70Y, a developing device 80Y, and an electric current detector.

The surface of the photoconductor 20Y is uniformly charged at a negative polarity by the charger 70. Potential of part of the uniformly charged surface of the photoconductor 20Y to which the laser light is emitted from the laser writer 21 is damped to be an electrostatic latent image.

The developing device 80Y employs two-component developer including magnetic carriers and non-magnetic toner and performs two-component developing method; however, the developing device 80Y may employ one-component developer excluding magnetic carriers. The developing device 80Y includes an agitator section and a developing section housed within a development case. In the agitator section, the two-component developer (hereinafter, simply the developer) is agitated by three screws and is conveyed to the developing section. The developing section includes a developing sleeve 81Y that rotates while being opposite the photoconductor 20Y via an opening of the development case with a predetermined gap relative to the photoconductor 20Y. The developing sleeve 81Y includes a magnet roller secured so as not to rotate with the developing sleeve 81Y. The developer supplied to the development section from the agitator section is scooped up on a surface of the developing sleeve 81Y by a magnetic force of the magnet roller. The developer scooped up on the surface of the developing sleeve 81Y is conveyed with rotation of the developing sleeve 81Y, to a development area opposite the photoconductor 20Y. The developer is raised up by the magnetic force of the magnet roller to form a magnetic brush. In the development area, by the developing bias applied to the developing sleeve 81Y, developing potential for transferring toner onto an electrostatic latent image on the photoconductor 20Y acts on the toner in the developer. As a result, the toner in the developer transfers to the electrostatic latent image on the photoconductor 20Y, so that the electrostatic latent image is developed. Thus, a Y-toner image is formed on the photoconductor 20Y. The Y-toner image enters a primary transfer nip for Y-color following a rotation of the photoconductor 20Y.

The developer that has passed through the development area following the rotation of the developing sleeve 81Y is conveyed to an area where the magnetic force of the magnet roller is weakened, separates from the surface of the developing sleeve 81Y, and returns to the agitator section. The developer returned to the agitator section is agitated and conveyed with three screws, and supplied again to the development section. In advance, a toner density sensor detect the toner density of the developer, and an amount of toner determined in response to the detection results is replenished. This replenishment is performed by a controller that drives a toner replenisher according to the readings from the toner density sensor.

Heretofore, formation of a Y-toner image in the image forming unit 18Y for Y-color has been described, and the other C-color, M-color, and K-color toner images can be formed on each surface of the photoconductors 20C, 20M, and 20K via similar processes as in the Y-color toner image, in each of the image forming units 18C, 18M, and 18K for the colors of C, M, and K.

Primary transfer rollers 62Y, 62C, 62M, and 62K for Y, C, M, and K are disposed inside the loop of the intermediate transfer belt 10. The intermediate transfer belt 10 is nipped or sandwiched between the primary transfer rollers 62Y, 62C, 62M, and 62K and the photoconductors 20Y, 20C, 20M, and 20K. With this nipping, an outer surface of the intermediate transfer belt 10 contacts each of the photoconductors 20Y, 20C, 20M, and 20K, respectively, thereby forming four primary transfer nips for Y-, C-, M-, and K-color. A primary electric field is formed between the primary transfer rollers 62Y, 62C, 62M, and 62K and the photoconductors 20Y, 20C, 20M, and 20K, respectively, to which the primary transfer bias is applied.

The outer surface of the intermediate transfer belt 10 sequentially passes the primary transfer nip for Y-, C-, M-, and K-color along an endless move of the belt. During such a process, Y-, C-, M-, and C-toner images on the photoconductors 20Y, 20C, 20M, and 20K are sequentially superimposed on the outer surface of the intermediate transfer belt 10 as a primary transfer. With this, a four-color superimposed toner image is formed on the outer surface of the intermediate transfer belt 10.

An endless conveyance belt 24 stretched over a first tension roller 22 and a second tension roller 23 is disposed below the intermediate transfer belt 10, and is driven to rotate in the counterclockwise direction according to a rotation of one of the tension rollers 22 and 23. The outer surface of the conveyance belt 24 contacts a portion of the intermediate transfer belt 10 at which the third support roller 16 is wound, so that a secondary transfer nip is formed. A secondary transfer electric field is formed between the grounded second tension roller 23 and the third support roller 16 to which the secondary transfer bias is applied, around the secondary transfer nip.

Referring back to FIG. 1, the image forming section 100 includes a conveyance path 48 to sequentially convey the recording sheet 5 fed from the sheet feed device 200 or the bypass tray 6 to the secondary transfer nip, a fixing device 25 which will be described later, and to an ejection roller pair 56. Further, another conveyance path 49 is disposed to convey the recording sheet 5 conveyed from the sheet feed device 200 to the image forming section 100, to an entrance to the conveyance path 48. A registration roller pair 47 is disposed at the entrance to the conveyance path 48.

When a print job is started in response to a user's instruction, the recording sheet 5 fed out from the sheet feed device 200 or the bypass tray 6 is conveyed toward the conveyance path 48, and abuts the registration roller pair 47. The registration roller pair 47 starts rotation at a proper timing, thereby sending the recording sheet 5 toward the secondary transfer nip. The four-color superimposed toner image on the intermediate transfer belt 10 closely attaches to the recording sheet 5 at the secondary transfer nip. The four-color superimposed toner image on the intermediate transfer belt 10 is secondarily transferred en bloc onto the surface of the recording sheet 5 due to effects of secondary transfer electric field and nip pressure, so that a full-color toner image is formed on the surface of the recording sheet 5.

The recording sheet 5 that has passed through the secondary transfer nip is then conveyed to the fixing device 25 by the conveyance belt 24. The recording sheet 5 is pressed and heated inside the fixing device 25, so that a full-color toner image is fixed onto the surface of the recording sheet 5. Thereafter, the recording sheet 5 is discharged from the fixing device 25, is passed through the ejection roller pair 56, and is ejected onto the stack tray 7. Thus, the recording sheet 5 is from the sheet tray 201 to the stack tray 7 through a sheet conveyance route R.

Figure 6A:
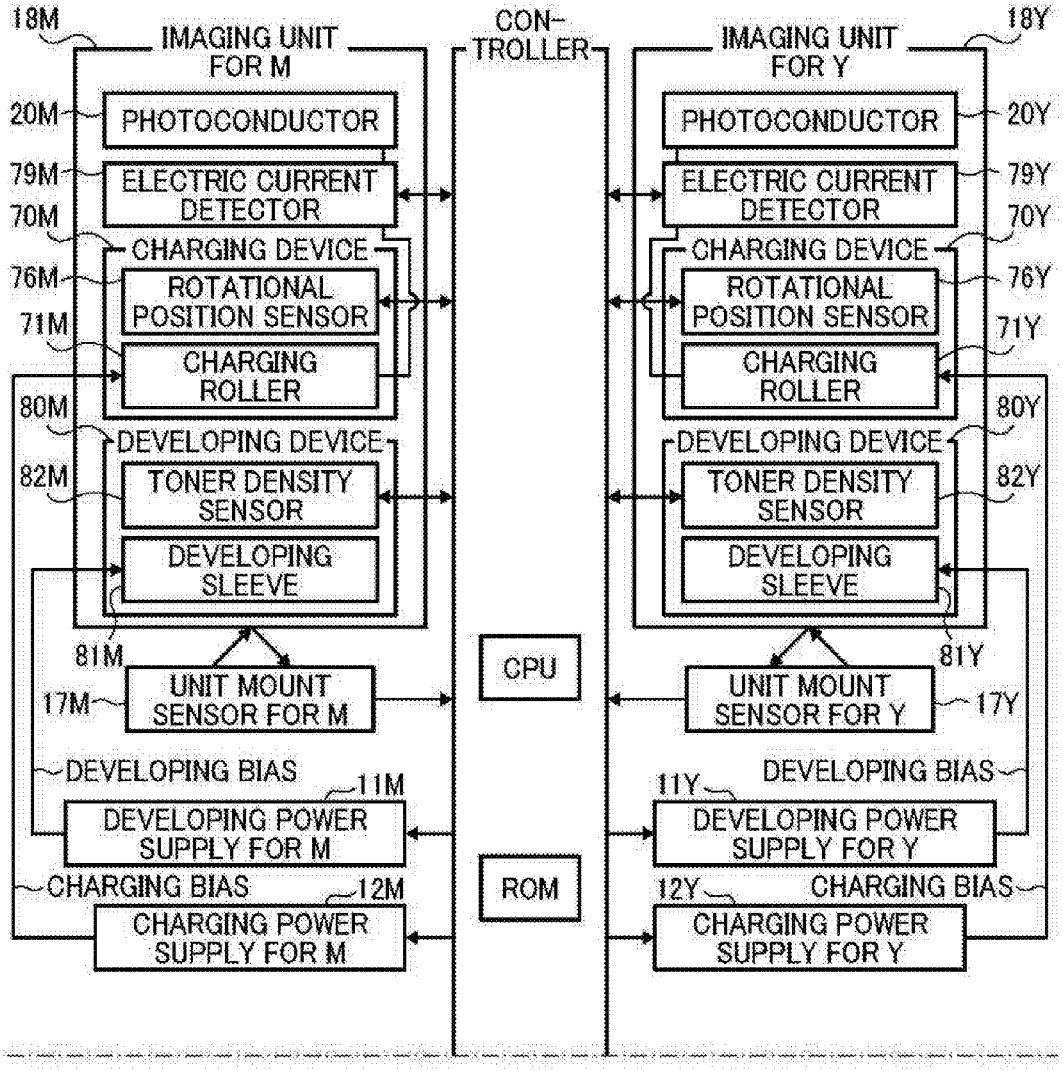
FIGS. 6A and 6B (collectively referred to as FIG. 6) are a block diagram of a part of an electric circuit of the copier of FIG. 1.
Figure 6B:
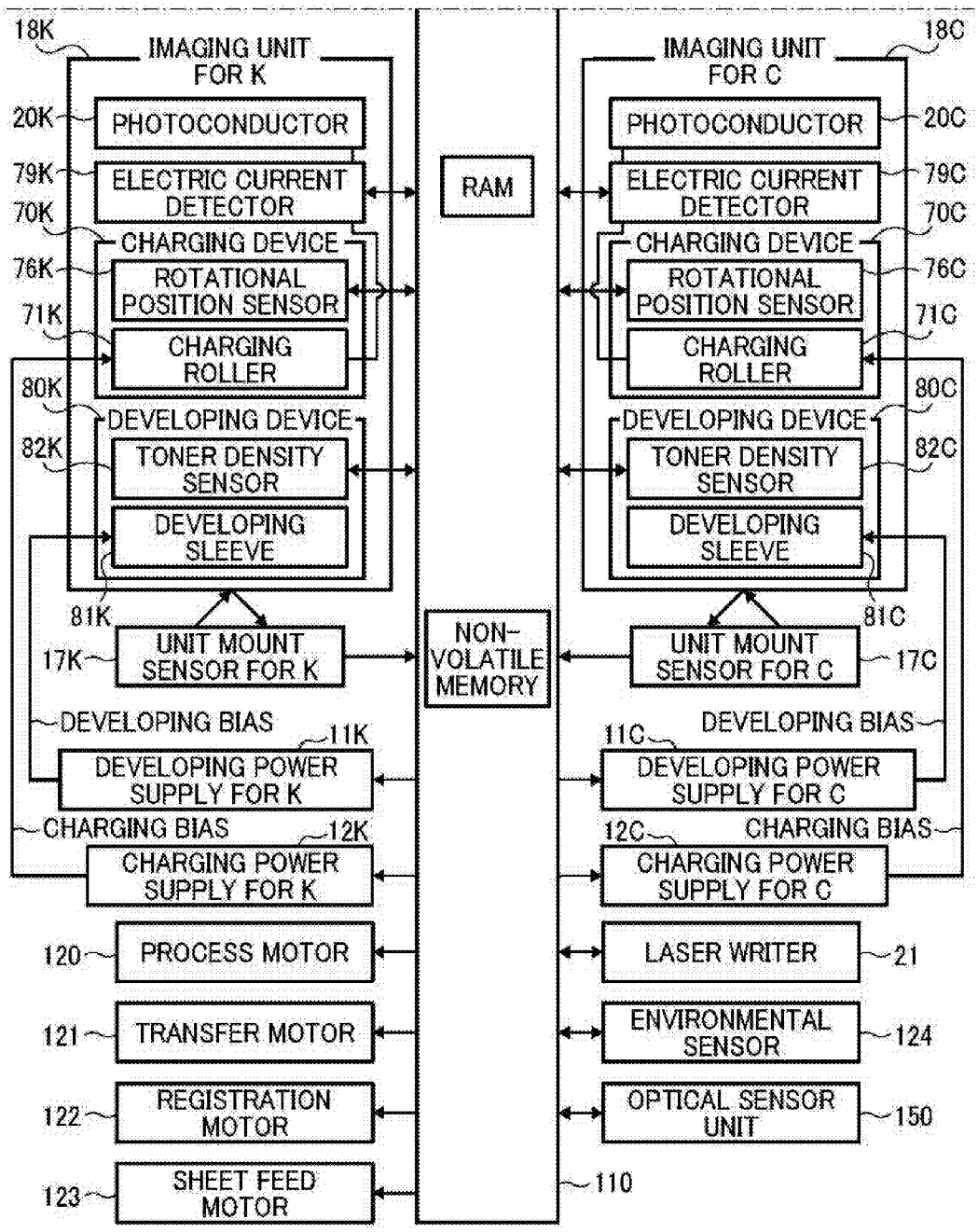

FIGS. 6A and 6B (collectively referred to as FIG. 6) are block diagrams of a part of electronic circuitry of the copier. In FIGS. 6A and 6B, the controller 110 includes a CPU, a RAM, a ROM, a nonvolatile memory, and the like. The toner density sensors 82Y, 82C, 82M, and 82K of the Y-, C-, M-, and K-color developing devices 80Y, 80C, 80M, and 80K, respectively, are electrically connected to the controller 110. With this structure, the controller 110 obtains each toner density of the Y-developer, C-developer, M-developer, and K-developer contained in the developing devices 80Y, 80C, 80M, and 80K, respectively.

Y-, C-, M-, and K-color unit attachment-and-detachment sensors 17Y, 17C, 17M, and 17K are also electrically connected to the controller 110. The unit attachment-and-detachment sensors 17Y, 17C, 17M, and 17K detect whether or not any of the image forming units 18Y, 18C, 18M, and 18K, is attached to or detached from the image forming section 100. With this structure, the controller 110 recognizes that the image forming units 18Y, 18C, 18M, and 18K are attached to or detached from the image forming section 100.

In addition, Y-, C-, M-, and K-color developing power supplies 11Y, 11C, 11M, and 11K are also electrically connected to the controller 110. Because the controller 110 outputs a control signal to each of the developing power supplies 11Y, 11C, 11M, and 11K individually, the controller 110 can adjust an amount of the developing bias output from the developing power supplies 11Y, 11C, 11M, and 11K, individually. Specifically, an amount of the developing bias to be applied to the Y-, C-, M-, and K-color developing sleeves 81Y, 81C, 81M, and 81K can be individually adjusted.

In addition, Y-, C-, M-, and K-color charging power supplies 12Y, 12C, 12M, and 12K are also electrically connected to the controller 110. Because the controller 110 outputs a control signal to each of the charging power supplies 12Y, 12C, 12M, and 12K, respectively, the controller 110 can adjust an amount of direct current voltage in the charging bias output from the charging power supplies 12Y, 12C, 12M, and 12K, individually. Specifically, the amount of direct current voltage in the charging bias to be applied to the Y-, C-, M-, and K-color charging rollers 71Y, 71C, 71M, and 71K can be individually adjusted.

In addition, the rotational position sensors 76Y, 76C, 76M, and 76K each to detect whether each of the Y-, C-, M-, and K-color charging rollers 71Y, 71C, 71M, and 71K takes a predetermined rotary position are also electrically connected to the controller 110. Accordingly, the controller 110 recognizes separately whether each of the Y-, C-, M-, and K-color charging rollers 71Y, 71C, 71M, and 71K takes a predetermined rotary position, based on the output from the rotational position sensors 76Y, 76C, 76M, and 76K.

In addition, the laser writer 21, an environment sensor 124, an optical sensor unit 150, a process motor 120, a transfer motor 121, a registration motor 122, a sheet feed motor 123, and the like are also electrically connected to the controller 110. The environment sensor 124 detects temperature and humidity in the apparatus. The process motor 120 is a drive source of the image forming units 18Y, 18C, 18M, and 18K. The transfer motor 121 is a drive source of the intermediate transfer belt 10. The registration motor 122 is a drive source of the registration roller pair 47. In addition, the sheet feed motor 123 is a drive source of a pickup roller 202 that sends the recording sheet 5 from a sheet tray 201 of the sheet feed device 200.

In addition, electric current detectors 79Y, 79C, 79M, and 79K of the image forming units 18Y, 18C, 18M, and 18K are also electrically connected to the controller 110. The electric current detectors 79Y, 79C, 79M, and 79K and the optical sensor unit 150 are described later.

In the present copier, to stabilize the image density over a long time regardless of environmental changes, a process control is performed regularly at a predetermined interval. In the process control, first, Y-color patch pattern images including a plurality of patch-shaped Y-toner images are formed on the Y-color photoconductor 20Y, and transferred to the intermediate transfer belt 10. Similarly, C-, M-, and K-color patch pattern images are formed on the photoconductors 20C, 20M, and 20K, respectively, and are transferred onto the intermediate transfer belt 10 so as not to overlap each other. Then, the optical sensor unit 150 detects a toner adhesion amount of each toner image in the patch pattern images. Subsequently, image forming conditions, such as a the developing bias Vb, for each of the image forming units 18Y, 18C, 18M, and 18K are separately adjusted based on the readings obtained.

The optical sensor unit 150 includes four reflection-type photosensors disposed at predetermined intervals across the belt, that is, in the belt width direction of the intermediate transfer belt 10. Each reflection-type photosensor outputs a signal corresponding to an optical reflectance of the intermediate transfer belt 10 or of the patch-shaped toner image disposed on the intermediate transfer belt 10. Three of the four reflection-type photosensors receive both specular reflection light and diffusion reflection light on the surface of the belt so that these photosensors output signals corresponding to the Y-, M-, and C-toner adhesion amounts, and outputs signals corresponding to respective received light quantity. The residual one of the four reflection-type photosensors receives only specular reflection light on the surface of the belt so that the photosensor outputs a signal corresponding to the K-toner adhesion amount, and outputs a signal corresponding to the received light quantity.

The controller 110 performs process control at a predetermined time interval such as a power-on time to a main power supply, a standby time after a predetermined time has passed, and another standby time after a predetermined number of prints are output. When the process control is started, first, the controller 110 obtains environmental information such as number of prints, image coverage, temperature, and humidity, so that the controller 110 obtains individual development properties of the image forming units 18Y, 18C, 18M, and 18K. Specifically, the controller 110 calculates development γ and development start voltage for each color. More specifically, the controller 110 allows the chargers 70Y, 70C, 70M, and 70K to uniformly charge, while rotating, each surface of the photoconductors 20Y, 20C, 20M, and 20K. In charging, the charging bias output from the charging power supplies 12Y, 12C, 12M, and 12K is different from the output in normal printing. More specifically, among the direct current voltage and the alternating current voltage of the charging bias formed of superimposed bias, an absolute value of the direct current voltage is not constant, but gradually is increased. Using the photoconductors 20Y, 20C, 20M, and 20K charged by the above condition, the laser writer 21 scans with laser beams on each surface of the photoconductors 20Y, 20C, 20M, and 20K, so that a plurality of electrostatic latent images for each of the patch-shaped Y-, C-, M-, and K-toner images is formed. The thus-formed latent images are developed by the developing devices 80Y, 80C, 80M, and 80K, respectively, so that the Y-, C-, M-, and K-patch pattern images are formed on the photoconductors 20Y, 20C, 20M, and 20K, respectively. In the development, the controller 110 causes the absolute value of the developing bias to be applied to the Y-, C-, M-, and K-color developing sleeves 81Y, 81C, 81M, and 81K to gradually increase.

Figure 7:
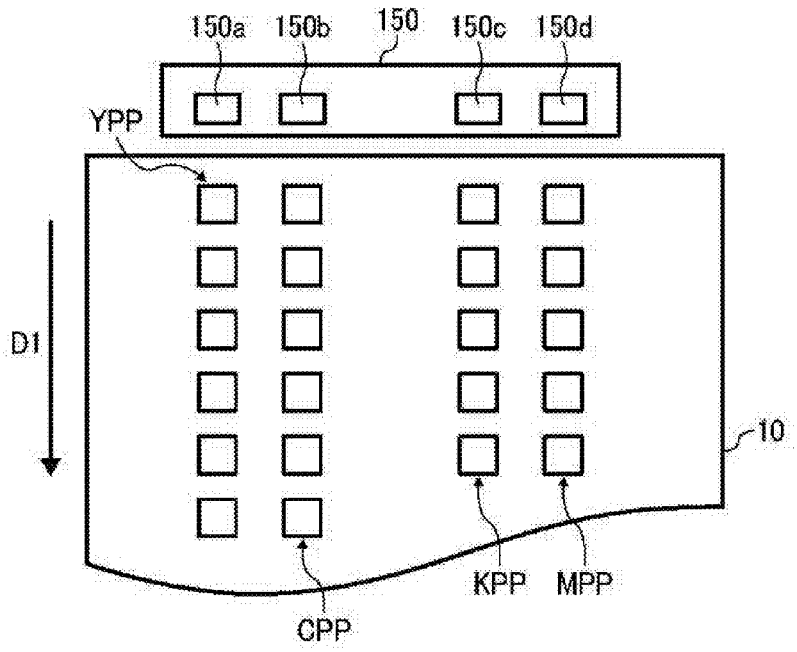
FIG. 7 is an illustration of patch pattern images transferred on an intermediate transfer belt of the image forming section of FIG. 2.

The Y-, C-, M-, and K-patch pattern images are arranged in the belt width direction so as not to overlap on the intermediate transfer belt 10 each other as illustrated in FIG. 7. Specifically, the Y-patch pattern image YPP is transferred to one end in the width direction of the intermediate transfer belt 10. Similarly, the C-patch pattern image CPP is transferred at a position shifted a little toward the center in the belt width direction than the YPP. In addition, the M-patch pattern image MPP is transferred to the other end in the width direction of the intermediate transfer belt 10. Further, the K-patch pattern image KPP is transferred at a position shifted a little toward the center in the belt width direction than the MPP. Patches of each of the Y-, C-, M-, and K-patch pattern images are formed along a direction of travel (rotation) of the intermediate transfer belt 10 indicated by arrow D in FIG. 7.

The optical sensor unit 150 includes a first reflection-type photosensor 150*a*, a second reflection-type photosensor 150*b*, a third reflection-type photosensor 150*c*, and a fourth reflection-type photosensor 150*d* to detect light reflectivity of the belt at different positions in the belt width direction. Of the four reflection-type photosensors 150*a* to 150*d*, the third reflection-type photosensor 150*c* detects only specular reflection light to detect a change in light reflectivity of the belt surface due to adhesion of black toner. By contrast, each of the other reflection-type photosensors 150*a*, 150*b*, and 150*d* detects both specular reflection light and diffuse reflection light to detect a change in light reflectivity of the belt surface due to adhesion of Y-, C- or M-toner.

The first reflection-type photosensor 150*a* is disposed at a position to detect the Y-toner adhesion amount of the patch-shaped Y-toner image of the Y-patch pattern image YPP formed at the end of the intermediate transfer belt 10 in the belt width direction. The second reflection-type photosensor 150*b* is disposed at a position to detect the C-toner adhesion amount of the C-color patch-shaped toner image of the C-patch pattern image CPP formed near the Y-patch pattern image YPP in the belt width direction. The fourth reflection-type photosensor 150*d* is disposed at a position to detect the M-toner adhesion amount of the M-color patch-shaped toner image of the M-patch pattern image MPP formed at the other end in the width direction of the intermediate transfer belt 10. The third reflection-type photosensor 150*c* is disposed at a position to detect the K-toner adhesion amount of the K-color patch-shaped toner image of the K-patch pattern image KPP formed near the M-patch pattern image MPP in the belt width direction. Note that each of the three reflection-type photosensors 150*a*, 150*b*, and 150*d* can detect the toner adhesion amount of any of Y-, M-, and C-colors other than black.

The controller 110 next calculates light reflectivity of the patch-shaped toner image of respective colors, based on the output signal sequentially sent from the four reflection-type photosensors of the optical sensor unit 150, obtains the toner adhesion amount based on the calculation result, and stores the obtained toner adhesion amount in the RAM. The patch pattern images of respective colors that have passed through the position opposite the optical sensor unit 150 along with the rotation of the intermediate transfer belt 10, are cleaned by the cleaning device from the outer surface of the belt.

The controller 110 calculates a linear approximation formula $Y=a\times Vb+b$, based on data of the toner adhesion amount stored in the RAM and data of the potential of an exposed portion (the potential of a latent image), stored in the RAM separately from the toner adhesion amount data. Specifically, the linear approximation formula represents a relation between the toner adhesion amount represented in Y-axis and the developing potential represented in X-axis, in X-Y coordinates. Then, based on the linear approximation formula, the developing bias is calculated so as to achieve a targeted toner adhesion amount, and the result is stored in non-volatile memory. After the above-described developing bias is calculated and stored for each of Y-, C-, M-, and K-color, the process-control process is finished. After that, in the print job, a voltage having the same value as the developing bias stored in the non-volatile memory is output from each of the developing power supplies 11Y, 11C, 11M, and 11K for each of Y-, C-, M-, and K-color.

By performing the above-described process-control process, the image density of an entire image can be stabilized with respect to each of Y-, C-, M-, and K-color for a long period of time. However, when focusing on parts of the image, uneven image density may be created due to uneven charging of the photoconductors 20Y, 20C, 20M, and 20K. Specifically, if charging rollers 71Y, 71C, 71M, and 71K have uneven electric resistance in a circumferential direction (direction of rotation), uneven charging will be created, on the photoconductors 20Y, 20C, 20M, and 20K, in the circumferential direction, whereby uneven image density will be created. In particular, on a halftone part such as a gray-level part and a highlight part, image density is easily affected by a charging potential of the photoconductor, whereby the uneven image density is highly visible.

The elastic layers of the charging rollers 71Y, 71C, 71M, and 71K contain, as an electric resistance adjusting agent, carbon and the like which are not ionic conductive agents. Such elastic layers do not create the fluctuation of uneven electric resistance due to the fluctuation over time of the distribution of ionic conductive agents; however, the uneven electric resistance cannot be reduced by changing the application voltage. For this reason, if there is initially uneven electric resistance, the uneven electric resistance keeps creating uneven charging of the photoconductor, and the uneven charging may keep creating the uneven image density.

Figure 8:
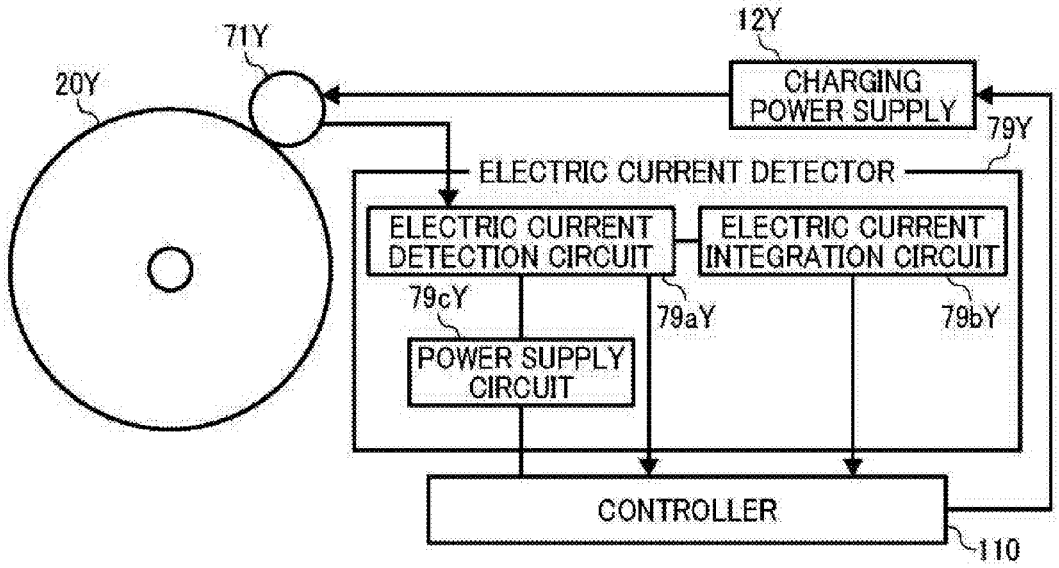
FIG. 8 is a structural view of an electric current detector for Y-color of the image forming section, together with a photoconductor and a charging roller each for Y-color.

Next, a characteristic configuration of a copier according to an embodiment will be described. FIG. 8 is a structural view showing the electric current detector 79Y for Y-color, together with the photoconductor 20Y and the charging roller 71Y each for Y-color. The electric current detector 79Y for Y-color has an electric current detection circuit 79*a*Y to detect current flowing between the charging roller 71Y and the photoconductor 20Y, a current integration circuit 79*b*Y to integrate the current value, and a power supply circuit 79*c*Y to output an electric power to drive the electric current detection circuit 79*a*Y. Although FIG. 8 shows only the electric current detector 79Y for Y-color of all the colors, the present copier has similar electric current detectors (79C, 79M, and 79K in FIG. 6) also for C-, M-, and K-color.

The controller 110 separately stores, in the non-volatile memory, a bias change data table used to cyclically change a charging bias to be applied to each of the charging rollers 71Y, 71C, 71M, and 71K. Thus, data construction processing is regularly performed to newly construct and update the bias change data table, based on the obtained uneven electric resistance, of the charging rollers 71Y, 71C, 71M, and 71K, in the direction of rotation.

In the data construction processing, the apparatus is started by the driving of the various devices, and the current flowing between the charging roller and the photoconductor is then detected at predetermined time intervals and is sequentially stored as current value data, with respect to each of Y-, C-, M-, and K-color. Specifically, the charging rollers 71Y, 71C, 71M, and 71K and the photoconductors 20Y, 20C, 20M, and 20K are rotationally driven, and the charging biases are output from the charging power supplies 12Y, 12C, 12M, and 12K, where each of the charging biases is constituted by a constant direct current voltage and an alternating current voltage having a constant peak-to-peak value superimposed on the constant direct current voltage. In this arrangement, the direct current voltage is −550 V, for example. With such conditions, sampling is started such that the currents flowing between the charging rollers 71Y, 71C, 71M, and 71K and the photoconductors 20Y, 20C, 20M, and 20K are detected by the electric current detectors 79Y, 79C, 79M, and 79K at predetermined time intervals and that the results are sequentially stored in the RAM. In the embodiment, the time interval is 1 ms, but is not limited thereto.

In the data construction processing, the controller 110 starts to monitor the output voltages from the rotational position sensors 76Y, 76C, 76M, and 76K immediately after the start of the sampling, and the controller 110 stores in the RAM the timing (hereinafter, referred to a "reference position timing") at which each of the output voltages falls. Such a process is performed until each of the charging rollers 71Y, 71C, 71M, and 71K is rotated at least six turns. By such sampling, current value sampling data and reference position sampling data are obtained for each of Y-, C-, M-, and K-color.

Figure 9:
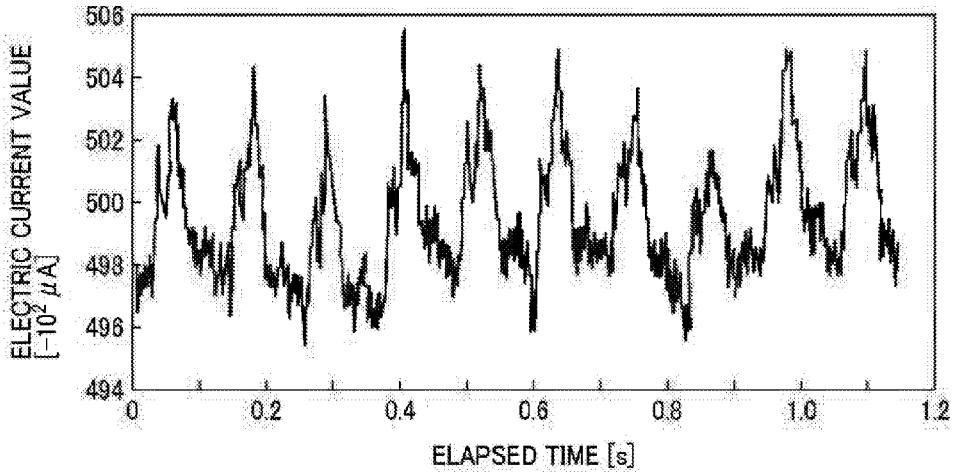
FIG. 9 is a graph of fluctuation over time, of a current value, generated based on current value sampling data obtained in an image forming unit for Y-color in an image forming section.

FIG. 9 is a graph showing fluctuation over time of a current value generated based on the current value sampling data obtained in an image forming unit 18Y for Y-color. With reference to FIG. 9, a sine-wave-like waveform repeatedly appears, and each one of the sine waves corresponds to the rotation cycle of the charging roller 71Y. In the sampling of the current values, the detection results of the current value are sampled in chronological order, for each of the charging rollers 71Y, 71C, 71M, and 71K, for a period of six or more rotation cycles of the roller.

As the graph in FIG. 9 shows, the current value fluctuates in a pattern synchronous with one cycle of the charging roller. This fluctuation is due to the uneven electric resistance, on the charging roller 71Y, in the circumferential direction. If the current value fluctuates as described above, the uneven charging is created, on the photoconductor 20Y, in the direction of rotation in accordance with the fluctuation. As a result, in the Y-toner image, the potential of an electrostatic latent image is unstable on a halftone part such as a highlight part and a gray-level part, on which exposure is hardly saturated, and the uneven image density will be created. A description is given above on the current value sampling data and the reference position sampling data obtained for the image forming unit 18Y for Y-color; however, the current value sampling data and the reference position sampling data are stored also for the image forming units of the other colors in a similar manner.

Next, the controller 110 constructs, for each of Y-, C-, M-, and K-color, six or more sets of current value fluctuation data for one cycle by dividing the current value data into the sets of data each corresponding to one cycle of the charging roller. Specifically, the reference position sampling data store six or more sets of the reference position timings, for each of the charging rollers 71Y, 71C, 71M, and 71K, in a period from the start to the end of the sampling. As the current value fluctuation data for one cycle for the first round, the controller 110 cuts out, from the current value sampling data, the data which has as the head data the data of the current value obtained at the first reference position timing of the six or more reference position timings contained in the reference position sampling data and which are obtained until immediately before the second reference position timing. Next, as the current value fluctuation data for one cycle for the second round, the controller 110 cuts out, from the current value sampling data, the data which has as the head data the data of the current value obtained at the second reference position timing and which are obtained until immediately before the third reference position timing. By similar process being repeated, each set of current value fluctuation data for one cycle for at least from the first round to the sixth round is eventually cut out from the current value sampling data. Then, average fluctuation data are obtained by averaging the six sets of current value fluctuation data for one cycle.

Figure 10:
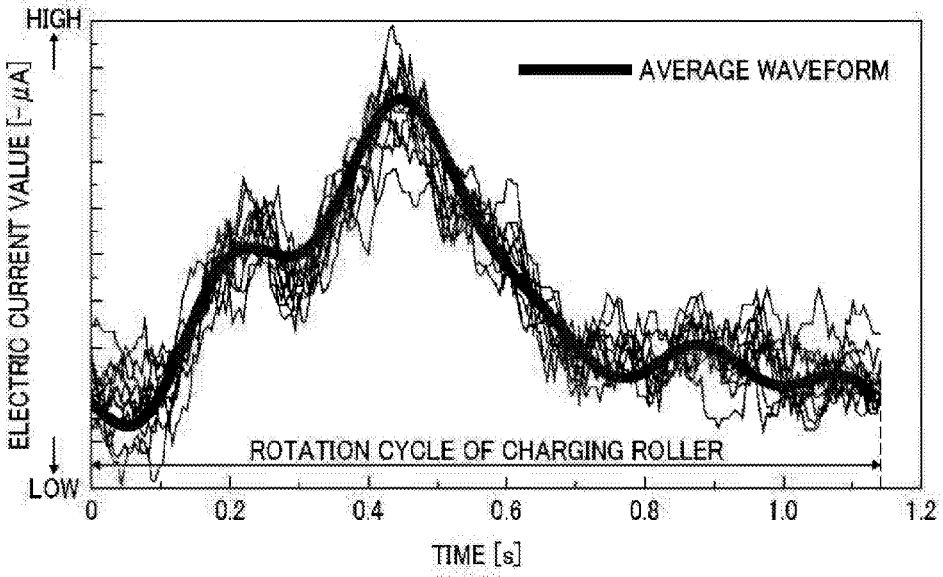
FIG. 10 is a graph of average fluctuation data of current value fluctuation data for one cycle.

FIG. 10 is a graph for describing the average fluctuation data of the current value fluctuation data for one cycle. With reference to FIG. 10, each of the thin curved lines is drawn based on plot points of the individual current value data of the current value fluctuation data for one cycle, and represents the fluctuation over time of the current value in one cycle of the charging roller. The thin curved lines overlapping with each other on many parts show that the fluctuation of the current value created at a cycle of the charging roller has a high reproducibility. Because the parts which do not overlap with each other are noise, those parts are preferably removed. Therefore, the controller 110 removes noise by obtaining the average fluctuation data of at least six sets of current value fluctuation data for one cycle. Specifically, the head data (the first current value data) of the six sets of current value fluctuation data for one cycle are first extracted, and the average value of the extracted data is stored as the head data of the average fluctuation data. Next, the second data of the six sets of current value fluctuation data for one cycle are each extracted, and the average value of the extracted data is stored as the second data of the average fluctuation data. In a similar manner, the data are obtained down to the last data to complete the average fluctuation data. Note that, the bold curve is drawn based on the plot points of the individual current value data of the average fluctuation data.

Figure 11:
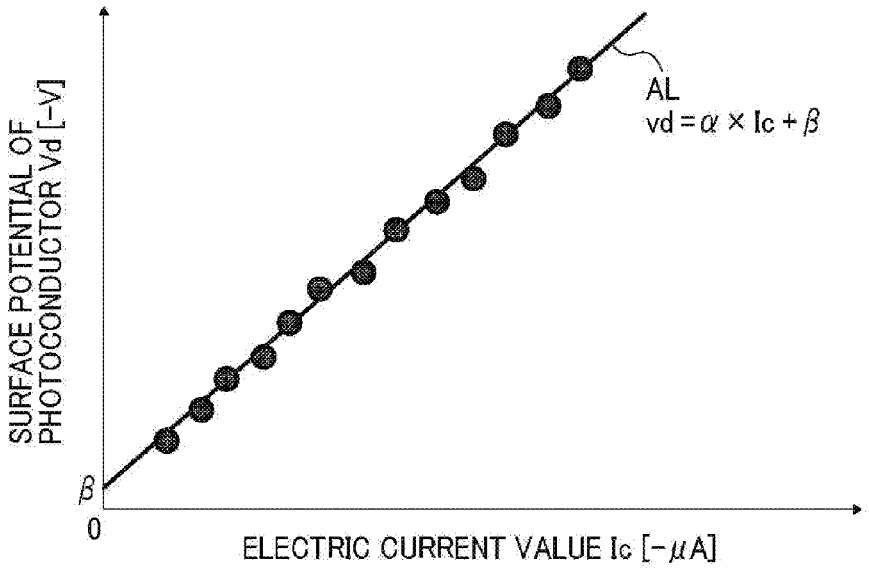
FIG. 11 is a graph of the relationship between a current value Ic detected by the electric current detector of the image forming section and a surface potential of a photoconductor charged with the condition of such a current value Ic.

FIG. 11 is a graph showing the relationship between a current value Ic detected by the electric current detectors 79Y, 79C, 79M, and 79K and a surface potential of the photoconductors 20Y, 20C, 20M, and 20K charged with the condition of the current value Ic. As indicated by an approximation straight line AL in FIG. 11, there is a linear relationship between the current value Ic and the surface potential of the photoconductor, and if the relationship is previously obtained by experiments or the like, the surface potential of the photoconductor can be obtained based on the current value Ic. The controller 110 stores in a non-volatile memory an algorism (hereinafter, referred to as a "conversion algorism") representing the above-mentioned relationship, for each of Y-, C-, M-, and K-color.

For each of Y-, C-, M-, and K-color, the controller 110 constructs, based on the conversion algorism and the average fluctuation data, fluctuation pattern data of a charging-bias's direct-current component for evenly charging the photoconductor regardless of the uneven electric resistance of the charging roller. Specifically, the fluctuation pattern data are constructed by converting, as shown in following Table 1, the data of the individual current values contained in the average fluctuation data into each of the charging-bias's direct-current component conversion values. If the direct current component having the same value as the head data (−550 V in an example of Table 1) of the fluctuation pattern data is output from the charging power supply at the reference position timing of the charging roller, the photoconductor can be charged at −550 V, for example. One millisecond after that, if the second data (−551 V in the example of Table 1) of the fluctuation pattern data is read in and the direct current component having the same value as the read-in result is output from the charging power supply, the charging potential of the photoconductor can be successively charged at −550 V.

TABLE 1

| SAMPLING NUMBER | SHIFT FROM STANDARD CURRENT VALUE [−μA] | CONVERSION VALUE OF CHARGING-BIAS DIRECT-CURRENT COMPONENT [−V] |
|---|---|---|
| 1 | 10 | 550 |
| 2 | 11 | 551 |
| 3 | 13 | 553 |
| 4 | 15 | 555 |
| 5 | 16 | 556 |
| 6 | 16 | 556 |
| 7 | 18 | 558 |
| 8 | 16 | 556 |
| 9 | 16 | 556 |
| 10 | 15 | 555 |
| 11 | 12 | 552 |
| 12 | 9 | 549 |
| . . . | . . . | . . . |

Figure 12:
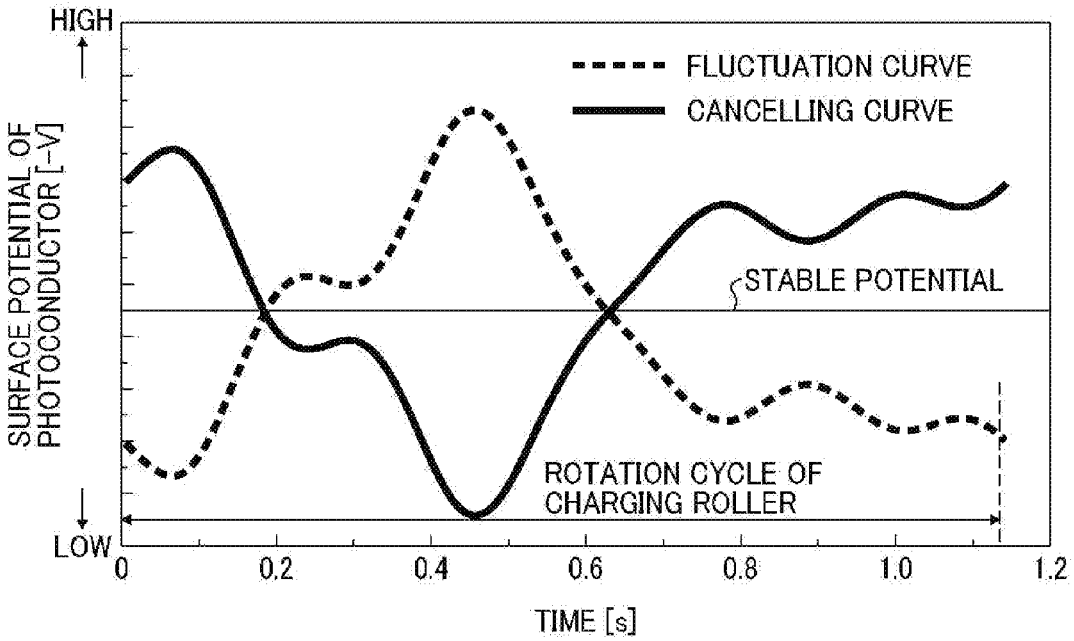
FIG. 12 is a graph of an example of the relationship among a fluctuation curve of the current value, a cancelling curve, and a stable potential.

FIG. 12 is a graph showing an example of the relationship among a fluctuation curve of current value, a cancelling curve, and a stable potential. With reference to FIG. 12, the fluctuation curve is the same as the curve of the average fluctuation data in FIG. 10, and shows the fluctuation pattern of current value created at a cycle of the charging roller. If the cancelling curve shown in the drawing is superimposed on the above-mentioned fluctuation curve, a straight line can be obtained which extends straight at the position of the stable potential shown in FIG. 12. That is, by normalizing with the cancelling curve shown in the drawing, the surface potential of the photoconductor can be stabilized at the stable potential. By temporally changing the direct current component of the charging bias according to the fluctuation pattern data, the cancelling curve shown in the drawing can be normalized. In a case of a model in which a variation rate of the direct current component of the charging bias and a variation rate of the surface potential of the photoconductor are completely the same, the bias change data table can be constructed by using the cancelling curve shown in the drawing as it is.

During a print job, the controller 110 performs voltage changing processing on each of Y-, C-, M-, and K-color as described below. That is, the output values (direct current components) of the direct current voltages from the charging power supplies 12Y, 12C, 12M, and 12K are changed based on the outputs of the rotational position sensors 76Y, 76C, 76M, and 76K and the change pattern data stored in the non-volatile memory for Y-, C-, M-, and K-color.

Figure 13:
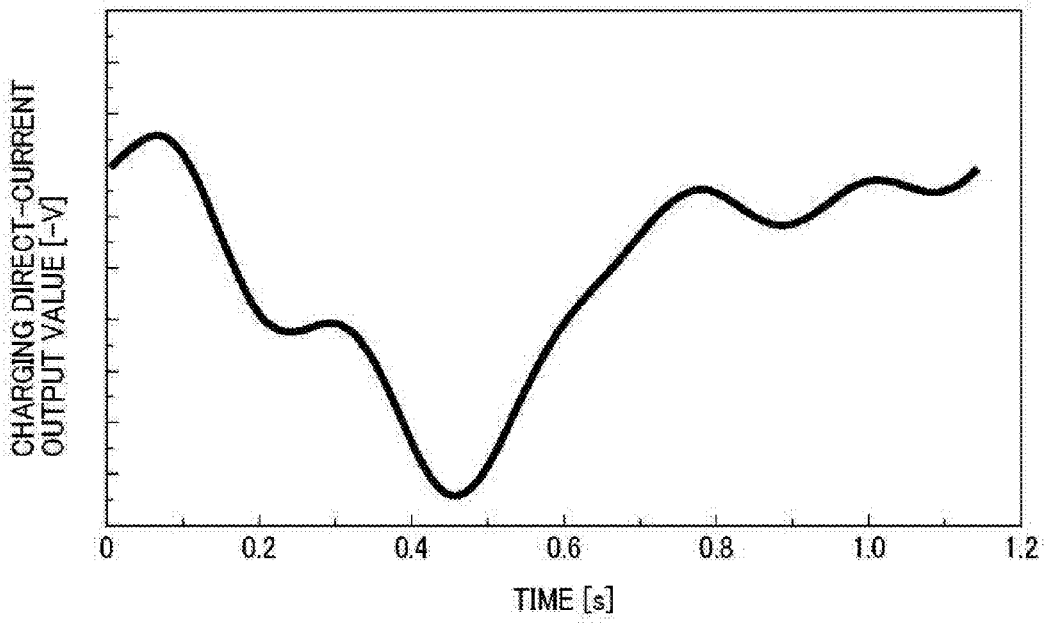
FIG. 13 is a graph of change over time of a direct current output value for charging in one cycle of a charging roller.

The controller 110 stores, in the non-volatile memory, Y-color change pattern data which can reproduce the curved line shown in FIG. 13 as the change pattern data for Y-color. With reference to FIG. 13, the vertical axis of the graph represents a direct current output value for charging [−V] as a direct current voltage value of the charging bias output from the charging power supply 12Y. In the present copier, in order to charge the surface of the photoconductor 20Y in a negative polarity, a negative polarity voltage is used as the direct current voltage to be superimposed on the alternating current component of the charging bias. The horizontal axis of the graph represents an elapsed time [s].

In the present copier, the charging roller 71Y is rotated at a cycle of approximately 1.15 s. The curved line shows the change over time of the direct current component (direct current output value for charging) [−V] of the charging bias in the cycle of 1.15 s. The controller 110 controls the charging power supply 12Y so as to achieve such change over time. Note that the time 0 s on the x-axis in the graph corresponds to the timing at which the output voltage from the rotational position sensor 76Y falls quickly from 6 V to about of 0 V. The Y-color change pattern data stored in the non-volatile memory can reproduce the change over time of the curved line shown in the drawing.

After starting the print job, the controller 110 reads in the head data (the direct current output value for charging corresponding to the time=0 s) of a bias change data table for Y-color when the controller 110 detects the output voltage to fall from the rotational position sensor 76Y. Then, the controller 110 controls the charging power supply 12Y to output a direct current voltage having the same value as the reading result. When time has elapsed, for example, 1 ms after that, the controller 110 reads in the second data (the direct current output value for charging corresponding to the time=1 ms) of the bias change data table for Y-color. Then, the controller 110 controls the charging power supply 12Y to output a direct current voltage having the same value as the reading result. By repeating the above control, the controller 110 temporally changes the direct current output value for charging in one cycle of the charging roller 71Y as shown by the curved line in FIG. 13. This process reduces the uneven charging of the photoconductor 20Y in the circumferential direction due to the uneven electric resistance of the charging roller 71Y in the circumferential direction; thus, the uneven image density due to the uneven charging are reduced.

Beside the Y-color change pattern data, the controller 110 stores, in the non-volatile memory, change pattern data for C-color, change pattern data for M-color, and change pattern data for K-color. Further, in the same manner as for the Y-color, the direct current output values for charging are changed also for C-, M-, and K-color to reduce the uneven image density, of the charging rollers 71C, 71M, and 71K, in the circumferential direction due to the uneven electric resistance.

Figure 14:
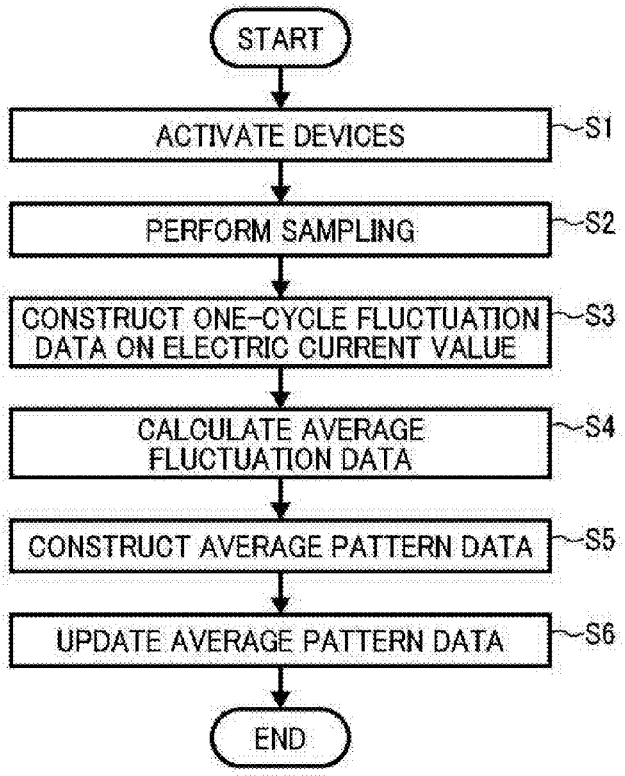
FIG. 14 is a flowchart of a processing flow of data construction processing performed by a controller of the image forming section.

FIG. 14 is a flowchart showing a processing flow of the data construction processing performed by the controller 110. The controller 110 starts the data construction processing, and immediately after that, the controller 110 first causes the various devices to start driving so that the apparatus is started (step S1: hereinafter "step" is represented by "S"). At this time, the direct current output value for charging of the charging bias, the developing bias, and a laser writing intensity each for each of Y-, C-, M-, and K-color are kept constant. In this condition, the detection result of the current value and the reference position timing for each color are sampled to obtain the current value sampling data and the reference position sampling data (S2). Next, a plurality sets of current value fluctuation data for one cycle are constructed for each color, based on those sampling data (S3), and then the average fluctuation data are calculated (S4). Then, the change pattern data are constructed based on the average fluctuation data (S5), and then the data in the non-volatile memory are updated to the constructed data (S6).

Figure 15:
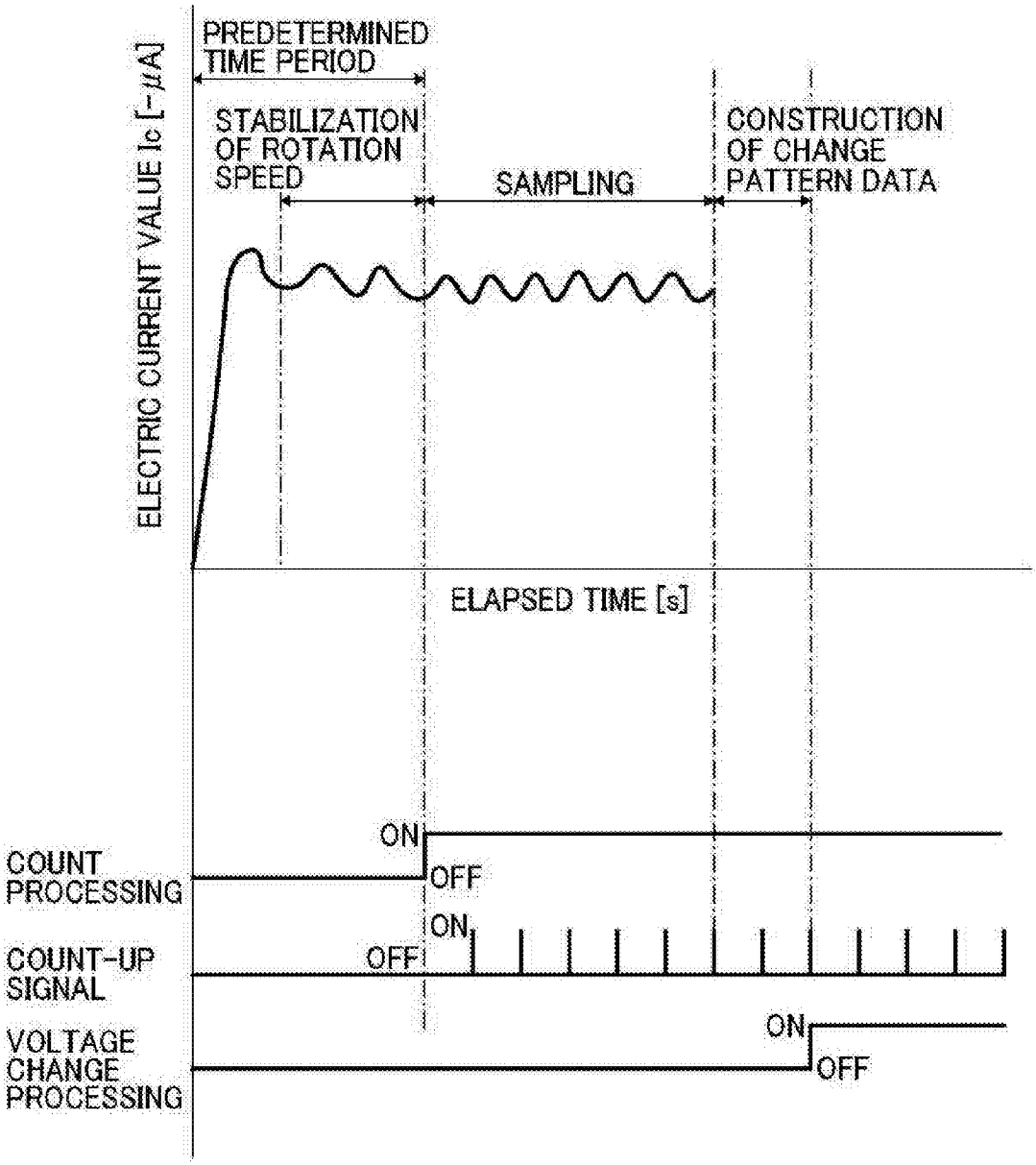
FIG. 15 is a graph of fluctuation over time of the current value, an execution timing of count processing, and a rising timing of a count-up signal in a copier according to a variation of an embodiment of the present invention.

Although the description is given on the example that the reference position timings of the charging rollers 71Y, 71C, 71M, and 71K are detected based on the detection results of the rotational position sensors 76Y, 76C, 76M, and 76K, other configurations may be used to obtain the reference position timings. For example, the following configuration may be used to obtain the reference position timings. Specifically, as shown in FIG. 15, the reference position timing is set at the rotational position of the charging roller at a timing (t1) when a time period (t1) required for the rotation speed of the charging roller to be stabilized at a predetermined speed has elapsed after the charging roller start to be rotationally driven (t0). Then, the count processing is started at that timing, and at the same time the sampling of the current values and the sampling of the reference position timings start. In the count processing, a count-up signal is repeatedly output and a count value is simultaneously reset to zero every time the rotational drive time (or rotation drive amount) of the charging roller reaches the one cycle of the charging roller (or the time corresponds to one round). This timing, at which the count-up signal is output, can be obtained as the reference position timing. The sampling is a process in which the current value is detected at an interval of 1 ms and is stored in the non-volatile memory as described above. Further, the sampling of the reference position timing is a process in which the count-up signal is stored at the timing when the signal is output.

After the sampling is performed for at least a period corresponding to six cycles of the charging roller, the change pattern data are constructed based on the current value sampling data and the reference position sampling data as described above. The count processing is not stopped but continued, and when the construction of the change pattern data is finished and the count-up signal is then output, the voltage changing processing is started to cyclically change the charging bias, based on the change pattern data. After that, image forming processing is started in response to a user's instruction, and during the image forming processing, the count processing is continuously performed, and the timing when the count-up signal is output may be obtained as a reference position timing. As described above, at the time of performing a print job in response to a user's instruction, if the count processing and the data construction processing are performed before formation of a toner image and if the toner image is then formed, the rotational position sensor does not have to be provided.

Figure 16:
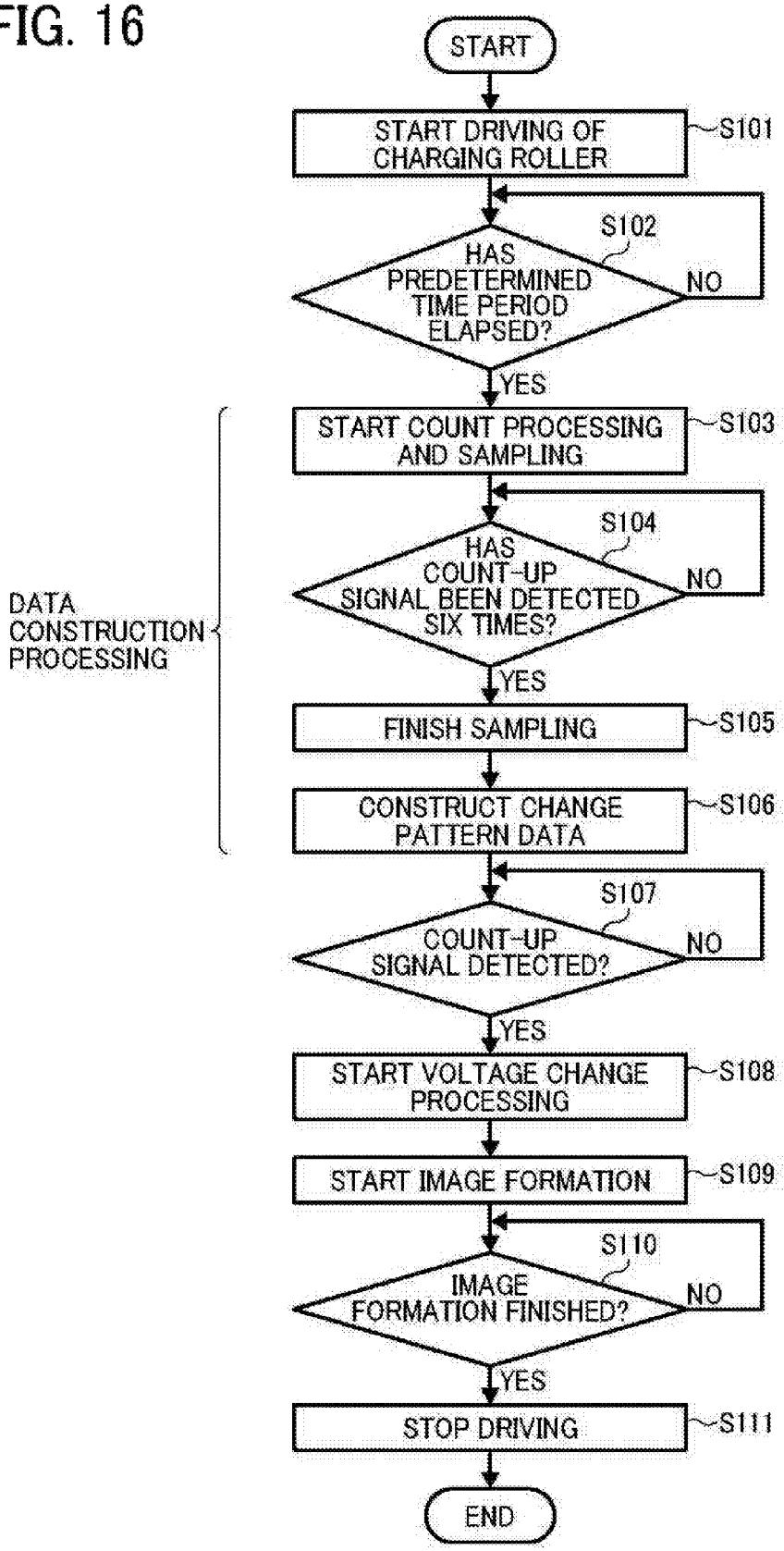
FIG. 16 is a flowchart of a control flow during a print job on a copier of a variation of an embodiment of the present invention.

FIG. 16 is a flowchart showing a control flow during a print job in a configuration in which the count-up signal is obtained as the reference position timing. Once the controller 110 starts a print job, the charging roller and the like start to be rotatably driven (S101), and then the process waits for a predetermined time (S102). Because the predetermined time is set longer than a period of time enough for the rotational drive speed of the charging roller to be stabilized, the rotational drive speed of the charging roller is stabilized at a predetermined speed when the predetermined time has elapsed. When the predetermined time has elapsed (S102: Yes), the above count processing and sampling are started, taking it as the reference position timing (S103). After that the detection of the count-up signal adds up to six times (S104: Yes), the sampling is terminated (S105), and the change pattern data are constructed (S106). When the construction of the change pattern data is finished, the voltage changing processing is started based on the change pattern data (S108) at the time when the count-up signal is detected again (S107: Yes). Next, the image forming processing is started (S109), and when the image formation of a toner image is finished (S1010: Yes), the driving of the devices is interrupted (S1011) to finish the series of the control flows.

Although, in the above example, the time when the count-up signal is output is obtained as the reference position timing, it is possible to obtain as the reference position timing a time which is a predetermined time sooner or later than the time when the count-up signal is output, in consideration of the response delay of the measurement or the output signal.

In the meantime, the inventors of the present application are developing an image forming apparatus in which the following configuration is provided instead of detecting the uneven electric resistance of the charging roller in the direction of rotation. Specifically, in the configuration, the uneven charging of the photoconductor in the direction of rotation is detected by a surface potential sensor, and the change pattern data of the charging bias capable of cancelling the uneven potential are constructed based on the detection result. Such configuration has an advantage that it is possible to detect, in addition to the uneven charging due to the uneven electric resistance of the charging roller, the uneven charging due to other causes such as the uneven sensitivity of the photoconductor of the photoconductive layer. However, the configuration also has the following disadvantage. That is, the disadvantage is that, in order to detect the uneven charging of the photoconductor in the main-scanning direction (rotary axis direction), the cost is increased.

Figure 17:
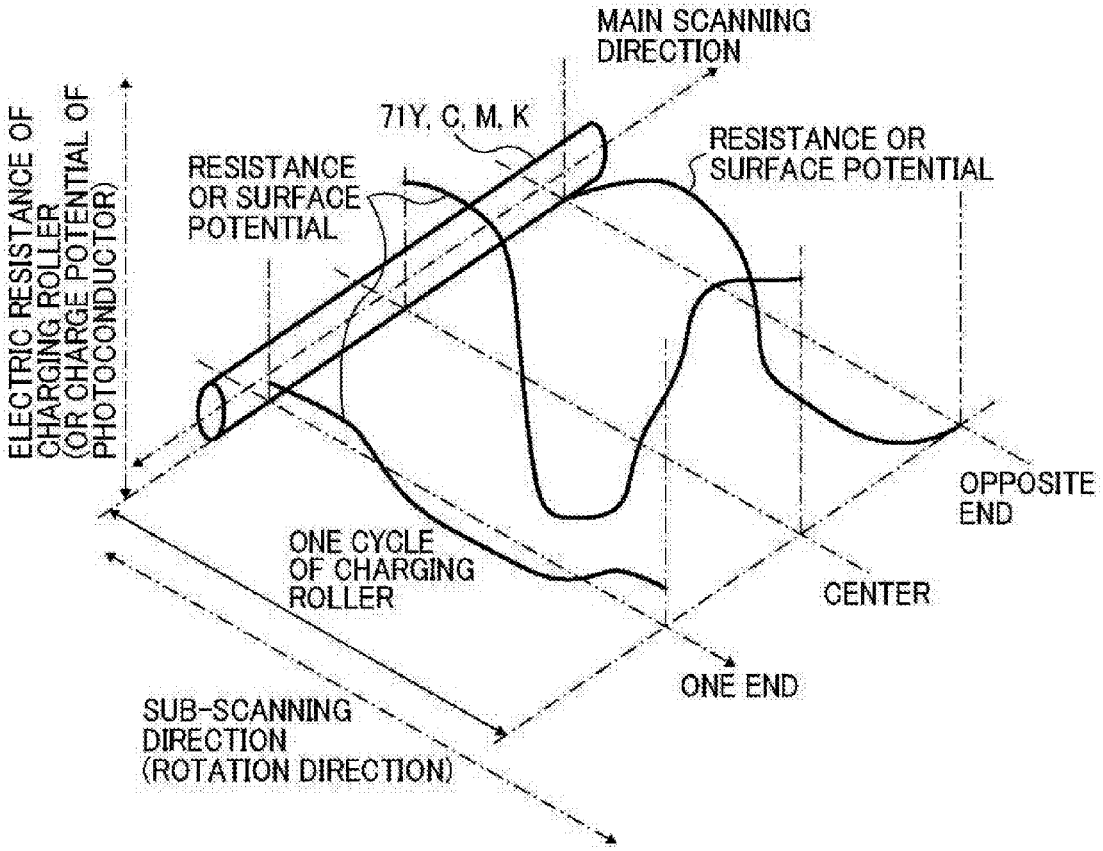
FIG. 17 is a perspective view of uneven electric resistance in a rotary axis direction of a charging roller.

Specifically, as shown in FIG. 17, the charging rollers 71Y, 71C, 71M, and 71K have, in addition to the uneven electric resistance in the direction of rotation, the uneven electric resistance in the rotary axis direction. Thus, the latter uneven electric resistance creates the uneven charging on the photoconductor in the main-scanning direction. In order to reduce the uneven charging in the main-scanning direction, it is preferable to apply a charging bias corresponding to the intermediate electric resistance in the uneven electric resistance of the charging roller in the rotary axis direction. However, the surface potential sensor to detect the uneven charging of the surface of the photoconductor is typically configured to detect only part of the surface potential of the photoconductor in the main-scanning direction. With such a configuration, for example in FIG. 17, with respect to the charging rollers 71Y, 71C, 71M, and 71K, what is detected is only the uneven charging due to the uneven electric resistance in the direction of rotation at one end, the center, or the other end in the rotary axis direction. Therefore, as described above, it is impossible to obtain the charging bias corresponding to the intermediate electric resistance. In order to obtain the intermediate electric resistance, it is necessary to also detect the uneven charging of photoconductor in the main-scanning direction; therefore, a plurality of surface potential sensors need to be arranged in the main-scanning direction, whereby the cost is increased.

On the other hand, with the configuration, in which the uneven electric resistance of the charging roller in the direction of rotation is detected, as in the present copier, based on the current value flowing between the charging roller and the photoconductor, the intermediate electric resistance in the main-scanning direction is naturally detected. That is because the current value flowing between the charging roller and the photoconductor is an integral value of the current values flowing in individual regions in the main-scanning direction, and represents the center value of the electric resistance on the charging roller in the whole main-scanning direction region. Therefore, it is possible to effectively reduce the uneven charging of the photoconductor in the main-scanning direction with lower cost than with the configuration to detect the surface potential of the photoconductor.

The charging rollers (71Y, 71C, 71M, and 71K) do not always turn stably at a designed cycle (for example, 1.15 s). Due to an engagement error of gears, slip on the photoconductors 20Y, 20C, 20M, and 20K, and the like, the charging roller sometimes rotates at a cycle away from the designed cycle. In the case of a rotation in which the cycle becomes longer than the designed cycle in the voltage changing processing, after the last data of the bias change data table is read in and the read-in result is reflected on the direct current output value for charging, it reaches the time for reading in the next data before it reaches the reference position timing. Assume that, in such a case, until it reaches the reference position timing, the direct current output value for charging is kept at the same value as immediately before. In that case, if the reference position timing is not detected due to some unexpected reason, the direct current output value for charging is not changed appropriately and is kept constant in that rotation; thus, the uneven charging is created on the photoconductor. To address this issue, in the present copier, the controller 110 is configured to perform the following process on each of Y-, C-, M-, and K-color. Specifically, in the voltage changing processing, if it reaches the time for reading in the next data after the last data of the bias change data table is read in and before it reaches the reference position timing, the target data to be read from the bias change data table is returned to the head data. With such a configuration, even if the reference position timing is not detected for some unexpected reason in some rotation, it is possible to change appropriately the direct current output value for charging in that rotation so that the uneven image density can be reduced.

As described above, with respect to the charging rollers 71Y, 71C, 71M, and 71K, the rotation often rotates at a cycle away from the designed cycle. Assume that, in spite of the above situation, the data is read in, repeatedly at constant time intervals and independently of the table reference position timing, from the bias variation data table and that the reading-in position is returned to the head data after the last data is read in. With this operation, as the rotation goes on, the reading-in position of data is shifted from the appropriate position, and the uneven charging of the photoconductors 20Y, 20C, 20M, and 20K may thus be increased.

To address this issue, in the copier of the embodiment, the controller 110 is configured to perform the following process for each of Y-, C-, M-, and K-color. Specifically, every time the reference position timing is detected by the rotational position sensors 76Y, 76C, 76M, and 76K, the target data to be read from the bias change data table is returned to the head data. With such a configuration, the direct current output value for charging can be changed appropriately independently of the error of the rotation cycle of the charging rollers 71Y, 71C, 71M, and 71K so that the creation of the uneven image density is effectively reduced.

In the present copier, the following five timings are used as a regular timing at which the data construction processing is performed. The first timing is when every time a predetermined number of print jobs are performed. If a continuous print job is being performed to successively print images on a plurality of recording sheets when it reaches that timing, the continuous print job is temporarily interrupted to perform the data construction processing. Since the data construction processing is performed every time a predetermined number of print jobs are performed, it is possible to stably reduce uneven image density due to uneven electric resistance of the charging roller from being created regardless of the value of a cumulative execution count of print jobs.

The second timing is after the reception of a print instruction from a user and before the start of the print job. With this configuration, because, when a print job is to be started, the data construction processing is performed before the print job, it is possible to stably reduce uneven image density due to the uneven electric resistance of the charging roller from being created even in the case that a print job is performed after the copier has not been used for a long period of time.

The third timing is immediately after the process-control process as an image forming condition adjusting processing is completed. With this configuration, appropriate bias change data table can be constructed with the image forming condition newly updated by performing the process-control process.

The fourth timing is when it is detected that the environment has changed more than a threshold in a predetermined time, based on a detection result by the environment sensor 124 as an environmental fluctuation detector. For example, the timing is when the temperature fluctuation equal to or higher than 4° C. per 10 minutes is detected. With this configuration, it is possible to avoid the reduction effect of the uneven image density from being lowered, where the lowering of the reduction effect is due to that the bias change data table cannot meet the environment which has largely fluctuated.

The fifth timing is when the attachment and detachment of one of the image forming units 18Y to 18K in any color are detected by the unit attachment-and-detachment sensor 17Y, 17C, 17M, or 17K as an attachment-and-detachment detector. With this configuration, it is possible to avoid the reduction effect of the uneven image density from being lowered by that the bias change data table cannot meet a new charging roller because of replacement of the image forming unit.

The description has been given to the copier according to the embodiment; however, the present invention is not limited to the configuration of the described copier, and various kinds of variation and modification may be made. For example, instead of a copier, examples include a printer, a facsimile machine, a multifunction peripheral, and the like. Further, examples include not only an image forming apparatus to form a color image but also a monochromatic image forming apparatus which can only form a monochrome image. Further, instead of a configuration in which an image is formed on only one side of a recording sheet, examples include an image forming apparatus in which images are formed on the both sides. Examples of recording sheet include a regular sheet, an overhead projector (OHP) sheet, a card, a postcard, a thick sheet, an envelope, and the like.

The above descriptions are only examples, and the present disclosure includes, for example, aspects having the following advantages.

Aspect A

An image forming apparatus according to aspect A includes an image forming device (for example, a device including the image forming unit 18Y, 18C, 18M, or 18K, the laser writer 21, and the like) which includes: a latent image bearer (for example, the photoconductor 20Y, 20C, 20M, or 20K); a charging rotator (for example, the charging roller 71Y, 71C, 71M, or 71K) to charge a surface of the latent image bearer while rotating; a charging power supply (for example, the charging power supply 12Y, 12C, 12M, or 12K) to output a voltage to be applied to the charging rotator; a latent image writing unit (for example, the laser writer 21) to write a latent image on the surface of the charged latent image bearer; and a developing unit (for example, the developing devices 80Y, 80C, 80M, and 80K) to develop the latent image to obtain a toner image. The image forming apparatus further includes: an electric current detector (for example, the electric current detector 79Y, 79C, 79M, or 79K) to detect a current flowing between the charging rotator to which the voltage output from the charging power supply is applied and the latent image bearer; and a controller (for example, the controller 110) to (i) determine an uneven electric resistance of the charging rotator in a direction of rotation of the charging rotator, based on a detection result by the electric current detector, (ii) performs, at a predetermined timing, data construction processing to construct change pattern data to change an output value of the voltage from the charging power supply according to a predetermined pattern, based on the uneven electric resistance, and (iii) performs, in a print job to form a toner image in response to an instruction, voltage changing processinging which charges the latent image bearer while changing the output value of the voltage from the charging power supply, based on the change pattern data.

In this configuration, the current flowing between the charging rotator and the latent image bearer is measured, not contacting and separating the charging rotator to and from the latent image bearer but keeping the charging rotator in contact with the latent image bearer, and the uneven electric resistance of the charging rotator in the direction of rotation is determined. Then, the change pattern data of the voltage to be applied to the charging rotator are constructed which can cancel the uneven charging of the latent image bearer due to the uneven electric resistance of the charging rotator. After that, the latent image bearer is charged in a print job while the application voltage to be applied to the charging rotator is being changed based on the change pattern data so as to cancel the uneven charging of the latent image bearer due to the uneven electric resistance of the charging rotator in the direction of rotation. By this operation, even if there is uneven electric resistance in the charging rotator, the uneven charging of the latent image bearer due to the uneven electric resistance is reduced during a print job. Thus, it is possible to reduce the creation of the uneven image density due to the uneven electric resistance of the charging rotator can be reduced without using a contact-and-separation assembly to contact and separate the charging rotator to and from the latent image bearer or the conductive roller.

Aspect B

Aspect B is characterized in that, in Aspect A, the controller is configured to, in the data construction processing, determine the uneven electric resistance, based on a detection result of a change over time of the current detected by the electric current detector while applying a constant voltage to the charging rotator in rotation. With this configuration, because the uneven electric resistance of the charging rotator is determined with the condition that a constant voltage is applied to the charging rotator, the uneven electric resistance can be determined more precisely than in a configuration in which a voltage is changed.

Aspect C

Aspect C is characterized in that, in Aspect B, the controller is configured to, in the data construction processing, start to detect the change over time of the current after the charging rotator starts to be driven to rotate and a rotation speed of the charging rotator is then stabilized. This configuration can avoid an accuracy of the determined uneven electric resistance from being lowered due to the determination of the uneven electric resistance while the rotation speed of the charging rotator is unstable.

Aspect D

Aspect D is characterized in that, in Aspect B or C, the controller is configured to, in the data construction processing, detect a change over time of the current in a period in which the charging rotator rotates at least one turn. This configuration allows the uneven electric resistance of the charging rotator to be determined over the entire circumference of the charging rotator.

Aspect E

Aspect E is characterized in that, in any one of Aspects B to D, the charging power supply outputs, as the voltage to be applied to the charging rotator, a superimposed voltage in which an alternating current voltage is superimposed on a direct current voltage, and the controller is configured to, in the data construction processing, construct, as the change pattern data, data to change the direct current voltage in the superimposed voltage. This configuration can reduce generation of the uneven charging of the latent image bearer due to the uneven electric resistance of the charging rotator by changing the direct current voltage of the superimposed voltage, based on the change pattern data.

Aspect F

Aspect F is characterized in that any one of Aspects B to E includes a rotational position detector to detect a rotational position of the charging rotator. The controller is configured to, in the data construction processing, determine the uneven electric resistance, based on a detection result of the rotational position by the rotational position detector and based on the detection result of the change over time of the current. The controller is further configured to, in the voltage changing processing, change the output value of the voltage from the charging power supply, based on the change pattern data and the detection result of the rotational position by the rotational position detector. With this configuration, even if there is an error in the rotation cycle of the charging rotator between rotations, the uneven electric resistance of the charging rotator in the direction of rotation can be determined accurately.

Aspect G

Aspect G is characterized in that, in Aspect F, the controller is configured to reset, in the voltage changing processing and at a timing when the rotational position detector detects a predetermined rotational position, a data reading-in position at which data of the change pattern data is read in. With this configuration, even if there is an error in the rotation cycle of the charging rotator between rotations, it is possible to accurately reduce the creation of the uneven charging of the latent image bearer due to the uneven electric resistance of the charging rotator in the direction of rotation.

Aspect H

Aspect H is characterized in that, in any one of Aspects B to G, the controller is configured to perform the data construction processing every time a print job is performed predetermined times. With this configuration, regardless of the cumulative execution count of a print job, the uneven image density due to the uneven electric resistance of the charging rotator can be stably reduced for a long period of time.

Aspect I

Aspect I is characterized in that any one of Aspects B to H includes an adhesion amount detector to detect a toner adhesion amount of a toner image formed by the image forming device. The controller is configured to perform, together with the data construction processing, image forming condition adjusting processing to adjust an image forming condition of the image forming device based on a toner adhesion amount of a test toner image, which is formed by the image forming device for image density detection, detected by the adhesion amount detector. With this configuration, the image forming performance of the determined image forming device can be determined accurately while generation of the uneven image density due to the uneven electric resistance of the charging rotator is reduced.

Aspect J

Aspect J is characterized in that any one of Aspects A to I includes an attachment-and-detachment detector which detects attachment and detachment of the charging rotator. The controller is configured to perform the data construction processing in response to detection of attachment and detachment of the image forming device by the attachment-and-detachment detector. With this configuration, even in the case that the charging rotator has been replaced and that the uneven electric resistance of the charging rotator has thus largely changed from before the replacement, the change pattern data are updated to the pattern data appropriate to the changed uneven electric resistance, based on the result of determination of the changed uneven electric resistance. By this operation, it is possible to avoid the uneven image density from getting worse in a case that the change pattern data may become inappropriate to the uneven electric resistance of the charging rotator due to the replacement of the charging rotator.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an image forming device including:

a latent image bearer;

a charging rotator to charge a surface of the latent image bearer while rotating;

a charging power supply to output a voltage to be applied to the charging rotator;

a latent image writing unit to write a latent image on the surface of the charged latent image bearer; and a developing unit to develop the latent image to obtain a toner image;

an electric current detector to detect a current flowing between the charging rotator to which the voltage output from the charging power supply is applied and the latent image bearer; and a controller to (i) determine an uneven electric resistance of the charging rotator in a direction of rotation of the charging rotator, based on a detection result by the electric current detector, (ii) perform, at a predetermined timing, data construction processing to construct change pattern data to change an output value of the voltage from the charging power supply according to a predetermined pattern, based on the uneven electric resistance, and (iii) perform, in a print job to form a toner image in response to an instruction, voltage changing processing to charge the latent image bearer while changing the output value of the voltage from the charging power supply, based on the change pattern data;

wherein the controller is configured to, in the data construction processing, determine the uneven electric resistance, based on a detection result of a change over time of the current detected by the electric current detector while applying a constant voltage to the charging rotator in rotation.

2. The image forming apparatus according claim 1, wherein the controller is configured to, in the data construction processing, start to detect the change over time of the current after the charging rotator starts to be driven to rotate and a rotation speed of the charging rotator is stabilized.

3. The image forming apparatus according to claim 1, wherein the controller is configured to, in the data construction processing, detect a change over time of the current in a period in which the charging rotator rotates at least one turn.

4. The image forming apparatus according to claim 1, wherein the charging power supply outputs, as the voltage to be applied to the charging rotator, a superimposed voltage in which an alternating current voltage is superimposed on a direct current voltage, and wherein the controller is configured to, in the data construction processing, construct, as the change pattern data, data to change the direct current voltage in the superimposed voltage.

5. The image forming apparatus according to claim 1, further comprising a rotational position detector to detect a rotational position of the charging rotator, wherein the controller is configured to, in the data construction processing, determine the uneven electric resistance, based on a detection result of the rotational position by the rotational position detector and based on the detection result of the change over time of the current, and wherein the controller is further configured to, in the voltage changing processing, change the output value of the voltage from the charging power supply, based on the change pattern data and the detection result of the rotational position by the rotational position detector.

6. The image forming apparatus according to claim 5, wherein the controller is configured to reset, in the voltage changing processing and at a timing when the rotational position detector detects a predetermined rotational position, a data reading-in position at which data of the change pattern data is read in.

7. The image forming apparatus according to claim 1, wherein the controller is configured to perform the data construction processing every time a print job is performed predetermined times.

8. The image forming apparatus according to claim 1, further comprising an adhesion amount detector to detect a toner adhesion amount of a toner image formed by the image forming device, wherein the controller is configured to perform, together with the data construction processing, image forming condition adjusting processing to adjust an image forming condition of the image forming device based on a toner adhesion amount of a test toner image, which is formed by the image forming device for image density detection, detected by the adhesion amount detector.

9. An image forming apparatus comprising:

an image forming device including:

a latent image bearer;

a charging rotator to charge a surface of the latent image bearer while rotating;

a charging power supply to output a voltage to be applied to the charging rotator;

a latent image writing unit to write a latent image on the surface of the charged latent image bearer; and a developing unit to develop the latent image to obtain a toner image;

an electric current detector to detect a current flowing between the charging rotator to which the voltage output from the charging power supply is applied and the latent image bearer;

a controller to (i) determine an uneven electric resistance of the charging rotator in a direction of rotation of the charging rotator, based on a detection result by the electric current detector, (ii) perform, at a predetermined timing, data construction processing to construct change pattern data to change an output value of the voltage from the charging power supply according to a predetermined pattern, based on the uneven electric resistance, and (iii) perform, in a print job to form a toner image in response to an instruction, voltage changing processing to charge the latent image bearer while changing the output value of the voltage from the charging power supply, based on the change pattern data; and an attachment-and-detachment detector to detect attachment and detachment of the charging rotator;

wherein the controller is configured to perform the data construction processing in response to detection of attachment and detachment of the image forming device by the attachment-and-detachment detector.

* * * * *